US009726368B2

(12) United States Patent
Chen

(10) Patent No.: US 9,726,368 B2
(45) Date of Patent: Aug. 8, 2017

(54) ADJUSTABLE VORTEX FLAME DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 475 days.

(21) Appl. No.: 14/450,345

(22) Filed: Aug. 4, 2014

(65) Prior Publication Data

US 2015/0167962 A1 Jun. 18, 2015

Related U.S. Application Data

(63) Continuation-in-part of application No. 14/106,960, filed on Dec. 16, 2013, now Pat. No. 9,377,187.

(51) Int. Cl.

| | |
|---|---|
| ***F23C 7/00*** | (2006.01) |
| ***F23D 3/04*** | (2006.01) |
| ***F23D 3/20*** | (2006.01) |

(52) U.S. Cl.

CPC ..... *F23C 7/002* (2013.01); *F23C 7/008* (2013.01); *F23D 3/04* (2013.01); *F23D 3/20* (2013.01); *F23D 2207/00* (2013.01)

(58) Field of Classification Search

CPC ..... F23C 7/002; F23C 7/004; F23C 7/006; F23C 7/02; F23C 7/008; F23D 3/20; F23D 3/04; F23D 2207/00

See application file for complete search history.

(56) References Cited

U.S. PATENT DOCUMENTS

| | | | | |
|---|---|---|---|---|
| 2,515,845 | A | 7/1950 | Van Den Bussche | |
| 3,493,180 | A | 2/1970 | Walsh | |
| 7,097,448 | B2 | 8/2006 | Chesney | |
| D621,873 | S | 8/2010 | Tsai | |
| 2004/0202978 | A1 | 10/2004 | Wong | |
| 2009/0016048 | A1 | 1/2009 | McBrien et al. | |
| 2012/0006316 | A1 | 1/2012 | Shimek et al. | |
| 2012/0152230 | A1* | 6/2012 | Armanni | F23D 14/065 126/39 E |
| 2013/0252188 | A1* | 9/2013 | Chen | F23D 14/06 431/353 |

FOREIGN PATENT DOCUMENTS

| | | |
|---|---|---|
| EP | 2642201 A1 | 9/2013 |
| GB | 406134 | 2/1934 |

* cited by examiner

*Primary Examiner* — Alfred Basichas
(74) *Attorney, Agent, or Firm* — Alan D. Kamrath; Kamrath IP Lawfirm, P.A.

(57) ABSTRACT

An adjustable vortex flame device includes a control head delimiting a through hole with an opening and including a flow guiding mechanism including a plurality of vanes and a flow control head inserting in the through hole. The flow control head includes a first member and a second member detachably engaging with each other and delimiting a first chamber and a second chamber connecting to each other. The two channels extend in the first member and to an outer periphery of the flow control head and connect to the first chamber. The flow control head has two flow outlets defined at distal ends of the two channels and a flow inlet defined at a distal end of the second chamber. A hollow and transparent shield is disposed above the control head and delimits a space fluidly connecting to the through hole.

14 Claims, 25 Drawing Sheets

ADJUSTABLE VORTEX FLAME DEVICE

CROSS REFERENCE TO RELATED APPLICATION

The present application is a continuation-in-part application of U.S. patent application Ser. No. 14/106,906 filed on Dec. 16, 2013, now U.S. Pat. No. 9,377,187, of which the entire disclosure is incorporated herein.

BACKGROUND OF THE INVENTION

1. Field of the Invention

The present invention relates to a vortex flame device and, particularly to an adjustable vortex flame device.

2. Description of the Related Art

U.S. Pat. No. 7,097,448 shows a vortex type gas lamp for producing an upwardly directed vortex flame inside a surrounding and confined boundary of a rotating body of air. An interface is located between the body of air which is devoid of gas and a central region of gas which is bounded by the interface during the operation of the gas lamp. All of the combustion of gas substantially occurs inside the interface. The gas lamp has a central axis and includes a base supplying combustible gas without air at and nearly adjacent to the central axis. A shield includes first and second axially extending sections structurally attached to the base in a fluid sealing relationship. The first and second sections of the shield are substantially identical and transparent to light, and each includes an impermeable wall having an arcuate inner surface and an arcuate outer surface. Each of the first and second sections of the shield has first and second edges extended axially. The gas lamp further includes first and second walls alternately overlapping one another. The first and second walls are adjacent to their edges and are spaced from one another to form tangentially directed ports, thereby forming an axially extending mixing chamber open at its side only through the ports. The first and second sections are arranged so that at the base they surround the entry of combustible gas and which receives air for combustion only through the ports. Thus, a flame resulting from the combustion process is spaced from the inner surfaces, and the peripheral body of air is devoid of gas entering through the ports. Generally, if no air is supplied for combustion, a flame will extinguish. Unfortunately, it is not easy to prevent excess air from entering the chamber through the ports and to create a stable swirling flame during combustion, since the ports are directly open to air. Furthermore, the height and swirling pattern of the flame are greatly disturbed by excess airflow through the ports due to wind, if the device is placed under an environment with wind. Notwithstanding, the base of the chamber is also heated during combustion and if there is not enough airflow through the base to provide cooling, the top surface of the base can be very hot and not safe to touch.

U.S. Design Pat. No. 621,873 shows a fire tornado lamp. A base includes a plurality of ports disposed circumferentially. A shield is transparent to light, is hollow and includes a passage. The base and the shield are connected to each other. Each port extends radially with respect to and is in communication with the passage. Each port is configured that it induces air into the passage in a direction substantially tangential to a circumference of the passage. Likewise, it is not easy to preclude excess air from entering through the ports, and winds easily disturb a flame of the fire tornado lamp. Also, the guided air flow that provides for combustion and cooling can only enter the chamber through the ports above the bottom of the burning flame at an angle perpendicular to the flame direction. This configuration can generate a swift swirling flame and can induce strong convection during combustion, but it is difficult to control the swirling speed and pattern of the flame, and the base of the device can be very hot.

In addition, a user can't interact with either of the two set forth devices to adjust the size of vortex flames of the devices.

The present invention is, therefore, intended to obviate or at least alleviate the problems encountered in the prior art.

SUMMARY OF THE INVENTION

According to the present invention, an adjustable vortex flame device includes a control head delimiting a through hole with an opening. The control head includes a flow guiding mechanism including a plurality of vanes disposed around a circumference of the opening one after another, and two adjacent vanes includes a spiral air passage formed therebetween. A flow control head inserts in the through hole. The flow control head includes a first member and a second member detachably engaging with the first member. The flow control head delimits a first chamber and a second chamber connecting to the first chamber. Two channels extend in the first member and to an outer periphery of the flow control head. The two channels connect to the first chamber. The flow control head has two flow outlets defined at distal ends of the two channels and a flow inlet defined at a distal end of the second chamber. The adjustable vortex flame device in use includes a fuel reservoir fluidly connecting to the flow inlet of the flow control head. The first chamber extends longitudinally along a first axis. The two channels are disposed symmetrically with respect to the first axis. Each of the two channels extends longitudinally along a second axis. The second axis offsets radially from the first axis. A hollow and transparent shield is disposed above the control head and delimits a space fluidly connecting to the through hole.

It is therefore an object of the present invention to provide a vortex flame device that produces a stable vortex flame.

Other objects, advantages, and new features of the present invention will become apparent from the following detailed description of the invention when considered in conjunction with the accompanied drawings.

DETAILED DESCRIPTION OF THE INVENTION

Figure 1:
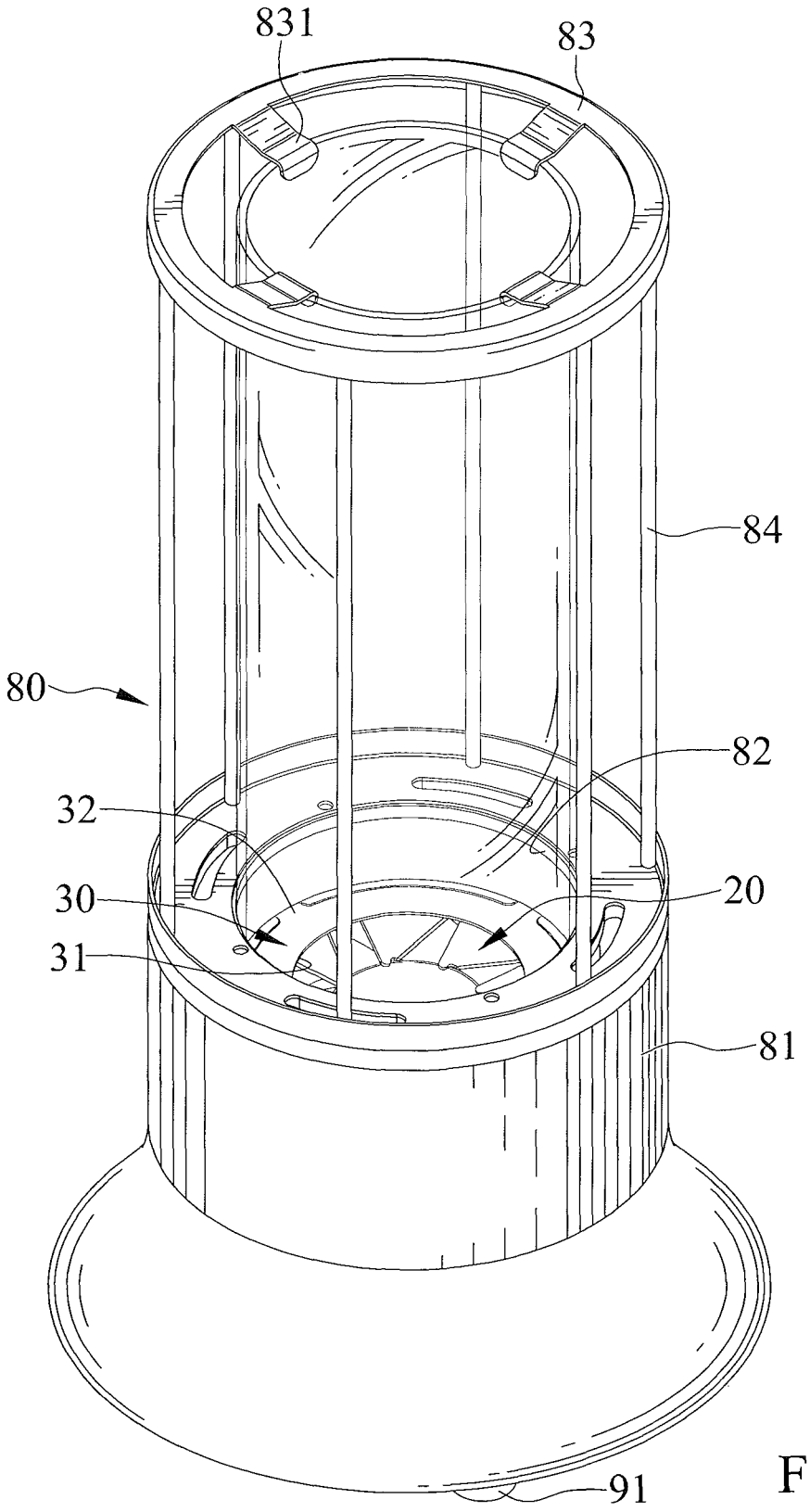
FIG. 1 is a perspective view of an adjustable vortex flame device in accordance with a first embodiment of the present invention.
Figure 2:
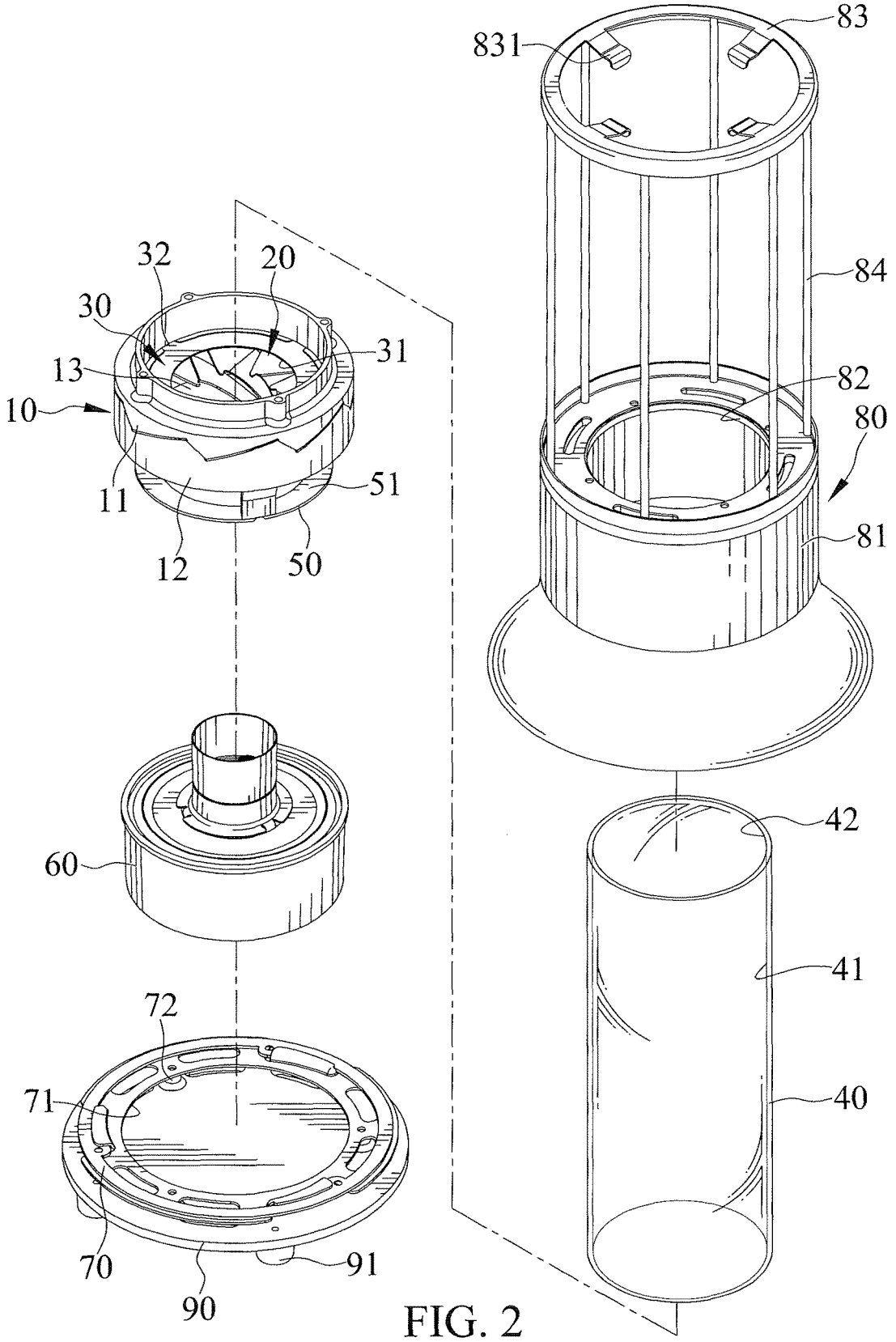
FIG. 2 is an exploded perspective view of the adjustable vortex flame device of FIG. 1.

FIGS. 1 through 7 show an adjustable vortex flame device in accordance with a first embodiment of the present invention. The adjustable vortex flame device includes a control head 10. The control head 10 delimits a through hole with an opening 13 with a diametrical size D. The control head. 10 includes a base having an inner periphery thereof delimiting the opening 13. The flow guiding and control mechanisms 20 and 30 are mounted on the base. The base includes a first base member 11 and a second base member 12 joined to the first base member 11. The opening 13 defines a first orifice 111 extending through the first base member 11 and a second orifice 121 extending through the second base member 12, respectively. The first base member 11 has a first engaging end 112, and the second base member 12 has a second engaging end 122 engaging with the first engaging end 112. The first engaging end 112 forms a plurality of first ridges each including first and second edges 1121 and 1122 and an apex defined therebetween, and the second engaging end 122 forms a plurality of second ridges each including third and fourth edges 1221 and 1222 and an apex defined therebetween respectively. The first and second edges 1121 and 1122 of one of the plurality of first ridges correspondingly face the third and fourth edges 1221 and 1222 of one of the plurality of second ridges. The first and second edges 1121 and 1122 of one of the plurality of first ridges have an included angle of greater than 90 degrees. The third and fourth edges 1221 and 1222 of one of the plurality of second ridges have an included angle of greater than 90 degrees.

The control head 10 includes a flow guiding mechanism 20 including a plurality of vanes 21. The flow guiding mechanism 20 is disposed below the opening 13. The plurality of vanes 21 is disposed around a circumference of the opening 13 one after another, with two adjacent vanes 21 including a spiral air passage 22 formed therebetween. Each of the plurality of vanes 21 has a first extension 211 secured between the first edge 1121 of one of the plurality of first ridges and the third edge 1221 of one of the plurality of second ridges and a second extension 212 extending from the first extension 211, and the air passage 22 between two adjacent vanes 21 are delimited by the second extensions 212 thereof. Each of the plurality of vanes 21 includes the second extension 212 extending from the first extension 211 obliquely. The first and second extensions 211 and 212 have an included angle of greater than 90 degrees. The plurality of vanes 21 is held securely between the first and second base members 11 and 12 with a plurality of joints 1223 which insert through the first extensions 211 of the plurality of vanes 21 and fixed to the plurality of securing sections 1123. The plurality of securing sections 1123 is formed on the first base member 11, and the plurality of joints 1223 extends from the second base member 12, respectively. The plurality of securing sections 1123 define defines a plurality of apertures, and the plurality of joints 1223 defines a plurality of projections, respectively. However, the present invention is not limited thereto. The plurality of vanes 21 includes a plurality of cavities 2111 which the plurality of joints 1223 inserts through. Therefore, the plurality of joints 1223 inserts through the plurality of vanes 21.

Figure 3:
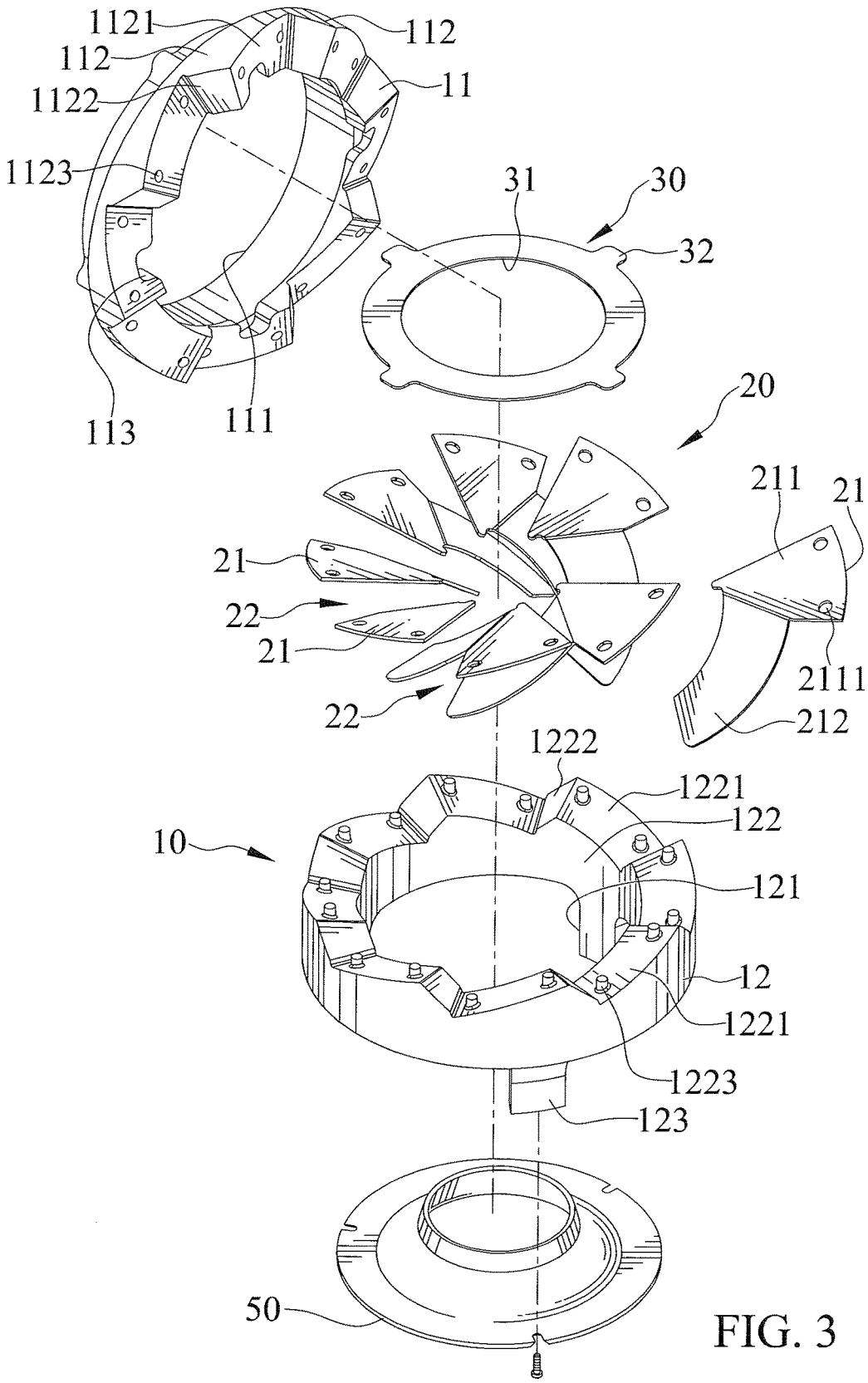
FIG. 3 is another exploded perspective view of the adjustable vortex flame device of FIG. 1.
Figure 4:
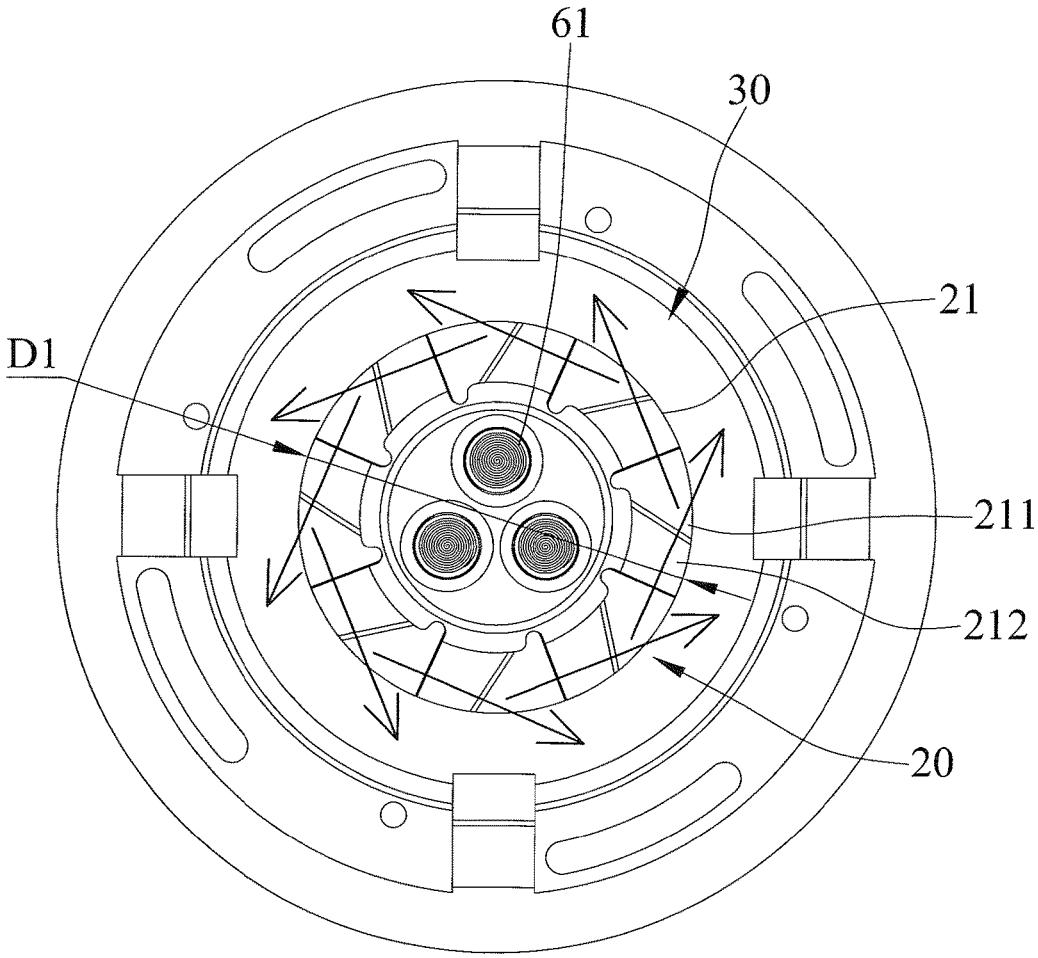
FIG. 4 is a top view of the adjustable vortex flame device of FIG. 1 and arrows indicate air flows.
Figure 5:
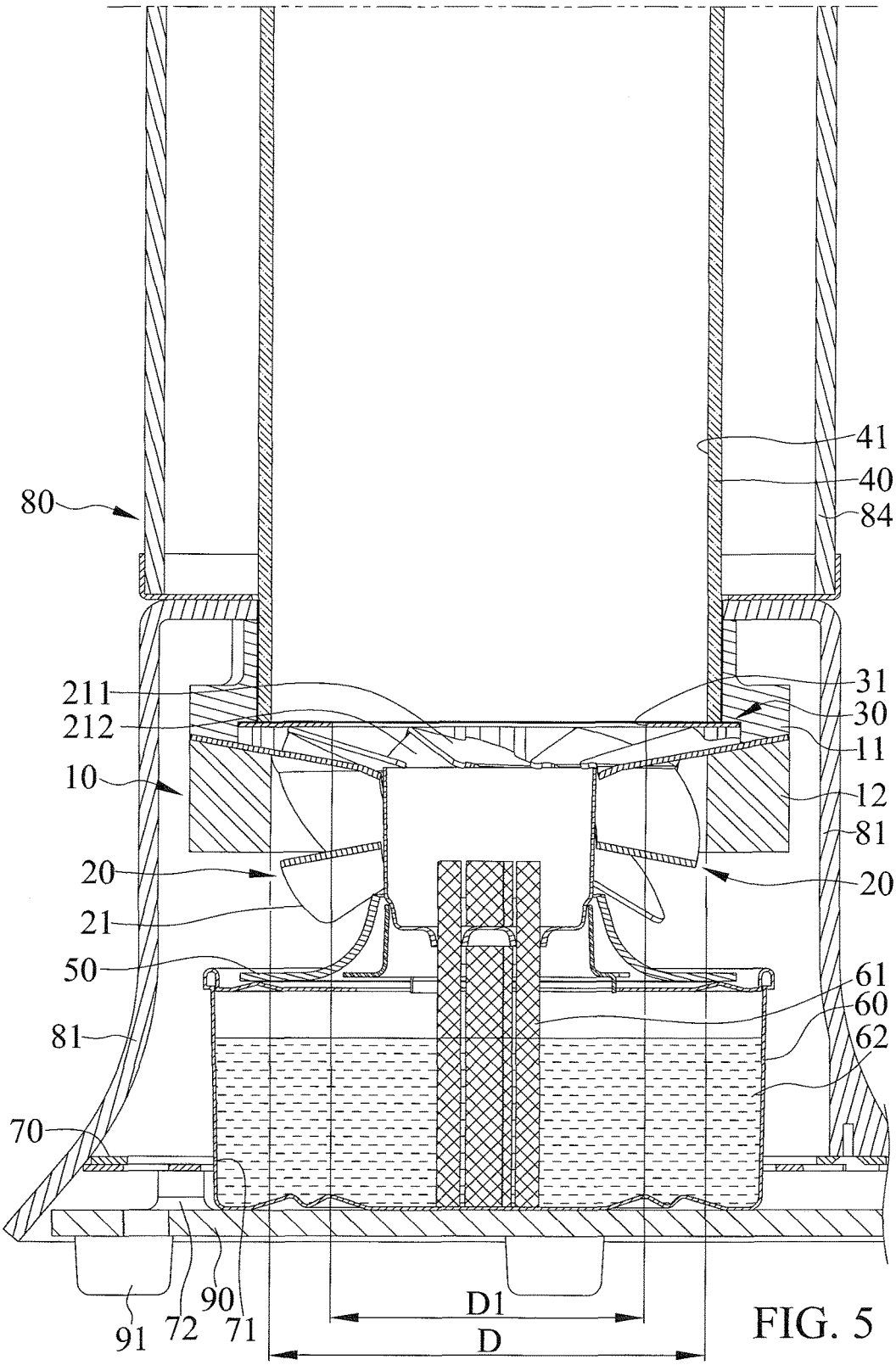
FIG. 5 is a partial cross-sectional view of the adjustable vortex flame device of FIG. 1.
Figure 6:
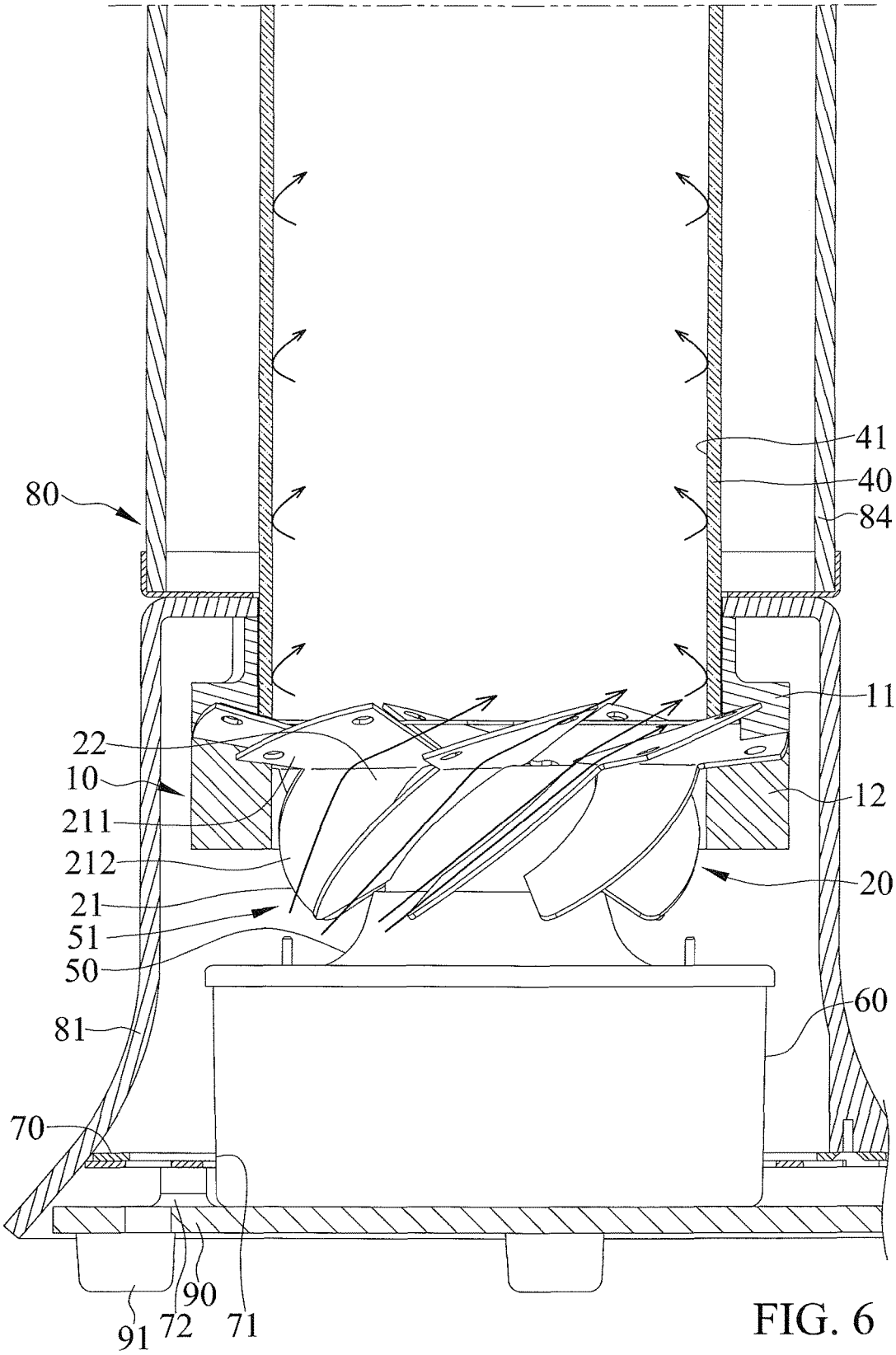
FIG. 6 is another partial cross-sectional view of the adjustable vortex flame device of FIG. 1, with arrows indicating air flows.

The control head 10 includes a control mechanism 30 delimiting a hole 31. Referring to FIG. 5, D1 indicates a diametrical size of the hole 31. The control mechanism 30 is an annular member secured to the first base member 11, and the hole 31 is delimited by an inner periphery of the annular member. The first base member 11 has at least one first fixing end 113 connecting with the opening 13, and the control mechanism 30 has at least one second fixing end 32 engaging with the at least one first fixing end 113. FIG. 3 shows the first base member 11 includes a plurality of first fixing ends 113 defining a plurality of slots, and the control mechanism 30 includes a plurality of second fixing ends 32 defining a plurality of projections respectively. In addition, the plurality of first fixing ends 113 is spaced apart from one another circumferentially along the inner periphery of the first base member 11. Likewise, the plurality of second fixing ends is spaced apart from one another circumferentially along the inner periphery of the control mechanism 30. The hole 31 has a diametrical size D1 and which varies with respect to different sizes of vortex flames of the adjustable vortex flame device. The hole 31 corresponds to and in is communication with the opening 13. The hole 31 is in a smaller diametrical size than the opening 13. The hole 31 of the control mechanism 30 has a first diametrical size. The control mechanism 30 is substitutable with another control mechanism 30 which includes the hole 31 thereof having a second diametrical size different from the first diametrical size, thereby influencing a size of a vortex flame of the adjustable vortex flame device.

A hollow and transparent shield 40 is disposed above the control head 10 and adjacent to the control mechanism 30. The shield 40 delimits a space 41 in communication with the hole 31 of the control mechanism 30. The space 41 fluidly connects to the through hole delimited by the control head 10. The shield 40 has two opposite open ends 42. The space 41 is between the two opposite open ends 42.

A seat 50 with at least one auxiliary air inlet 51 is fixed to and bears the base and with which a fuel reservoir 60 is adapted to connect. The base includes at least one connecting section 123 with which the seat 50 is engaged to mount securely on the seat 50. The seat 50 includes the fuel reservoir 60 engaged therewith, and the fuel reservoir 60 includes a wick 61 and fuel 62, with the wick 61 drawing fuel 62 up into a vortex flame.

A fixing seat 70 is with a first bore 71 in which the fuel reservoir 60 is engaged to mount securely on the fixing seat 70 and a plurality of feet 72 for standing on a surface stably.

A frame 80 defines a housing 81 with a second bore 82 in which the control head 10, the flow guiding and control mechanisms 20 and 30, the seat 50, the fuel reservoir 60, and the fixing seat 70 are received, a securing ring structure 83 securing the shield 40, and at least one supporting structure 84 bearing the securing ring structure 83 to a height. The securing ring structure 83 includes a plurality of hooks 831 engaged with the shield 40, and the hooks 831 are spaced apart from one another circumferentially along the inner periphery of the securing ring structure 83.

A pedestal 90 engages with and bears the frame 80. The pedestal 90 includes a plurality of feet 91 that facilitate standing of the pedestal 90 on a surface stably.

Figure 7:
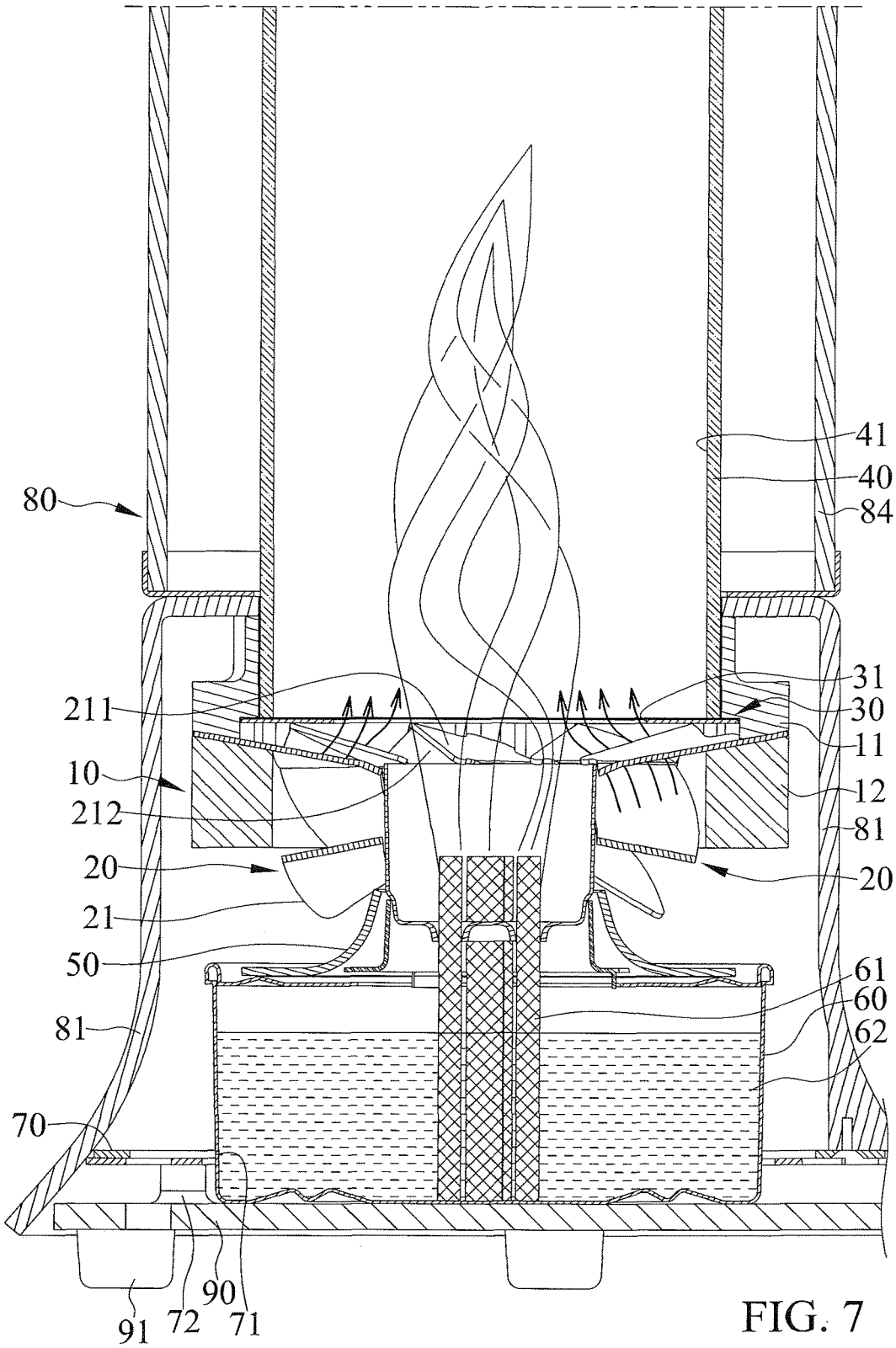
FIG. 7 is a cross-sectional view showing the adjustable vortex flame device of FIG. 1 producing a vortex flame, with arrows indicating air flows.
Figure 8:
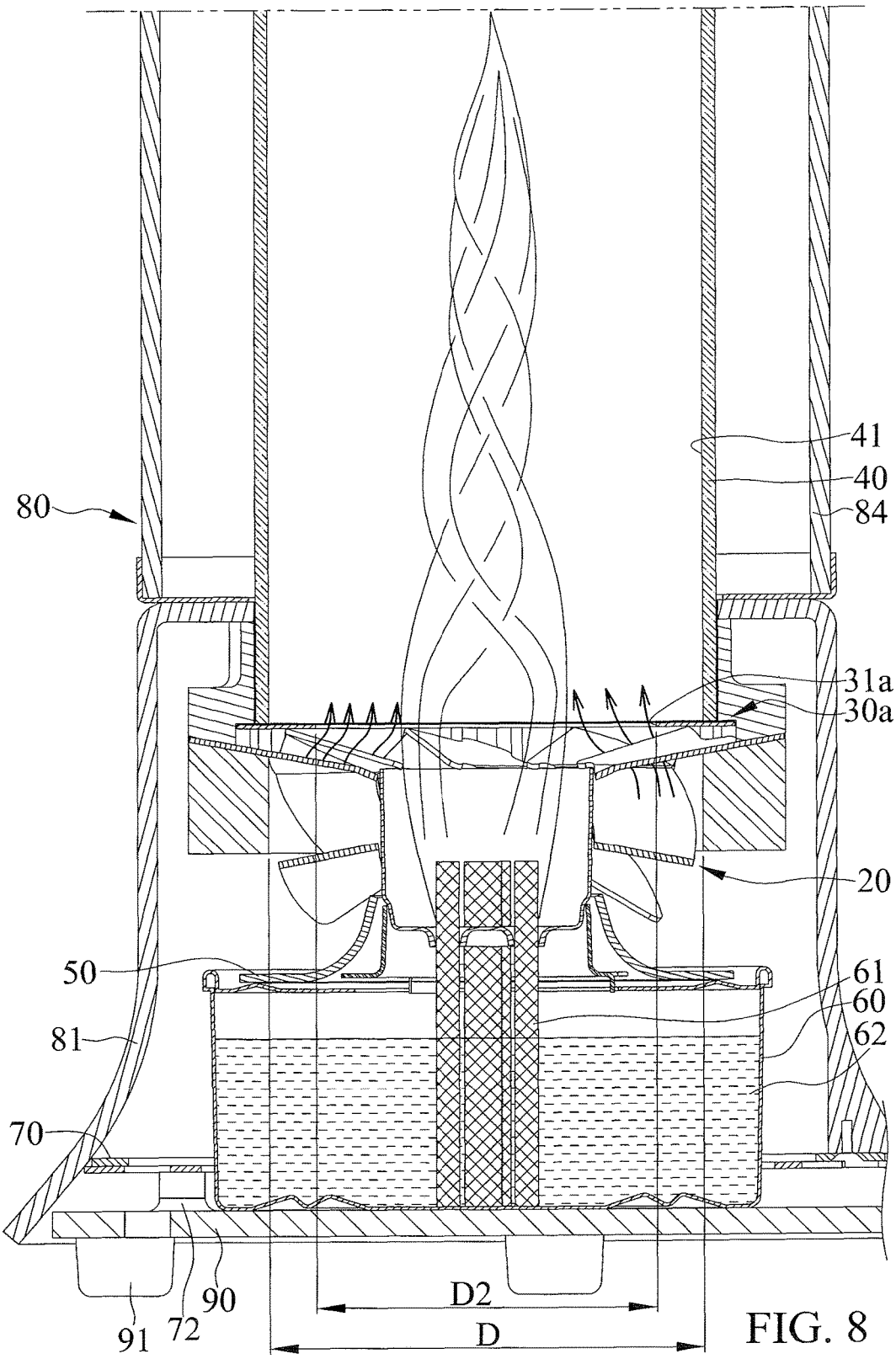
FIG. 8 is a cross-sectional view similar to FIG. 7, except that a hole of a control mechanism of the adjustable vortex flame device is in another size and a vortex flame of the adjustable vortex flame device is in another size consequently.
Figure 9:
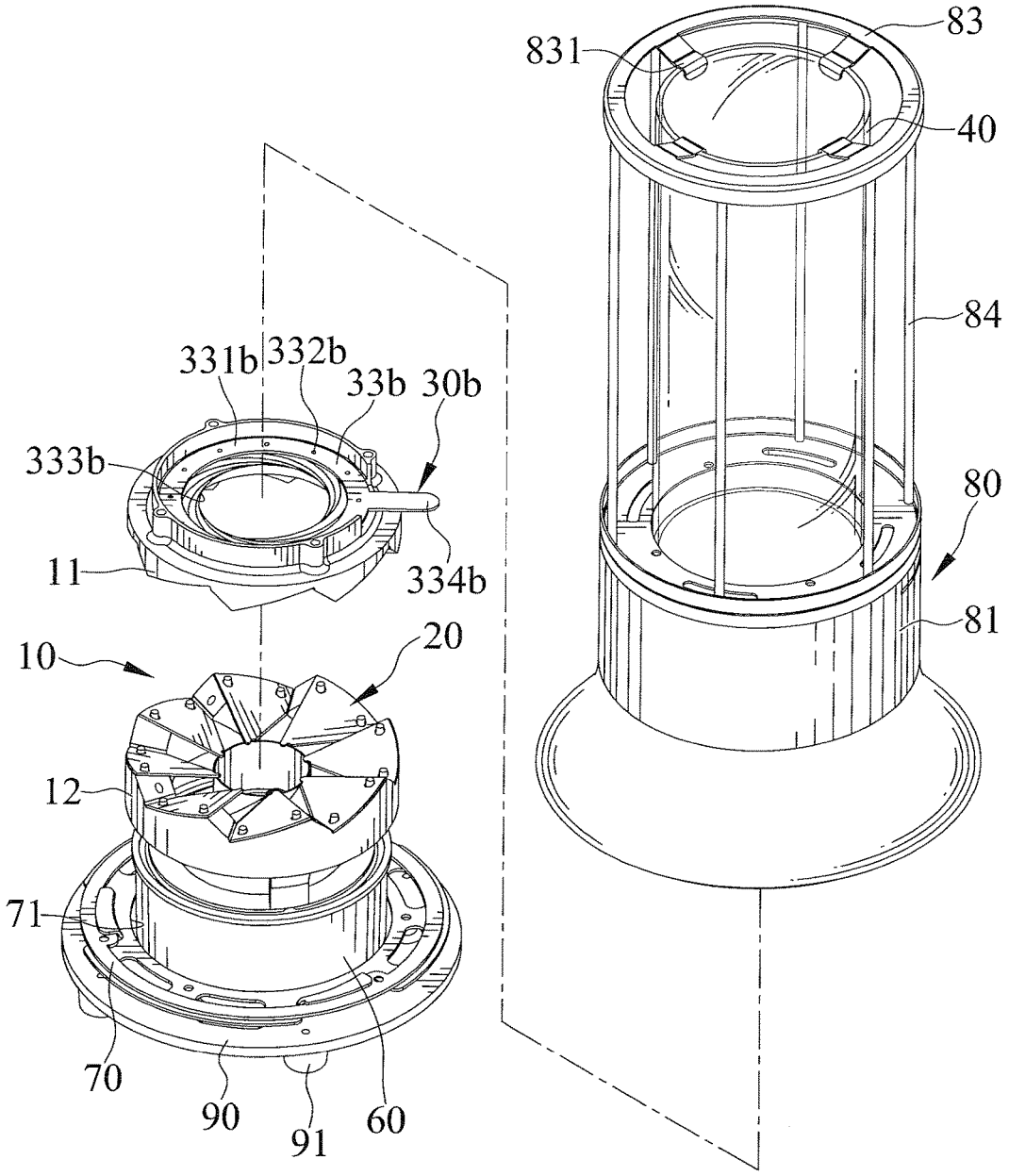
FIG. 9 is an exploded perspective view of an adjustable vortex flame device in accordance with a second embodiment of the present invention.
Figure 10:
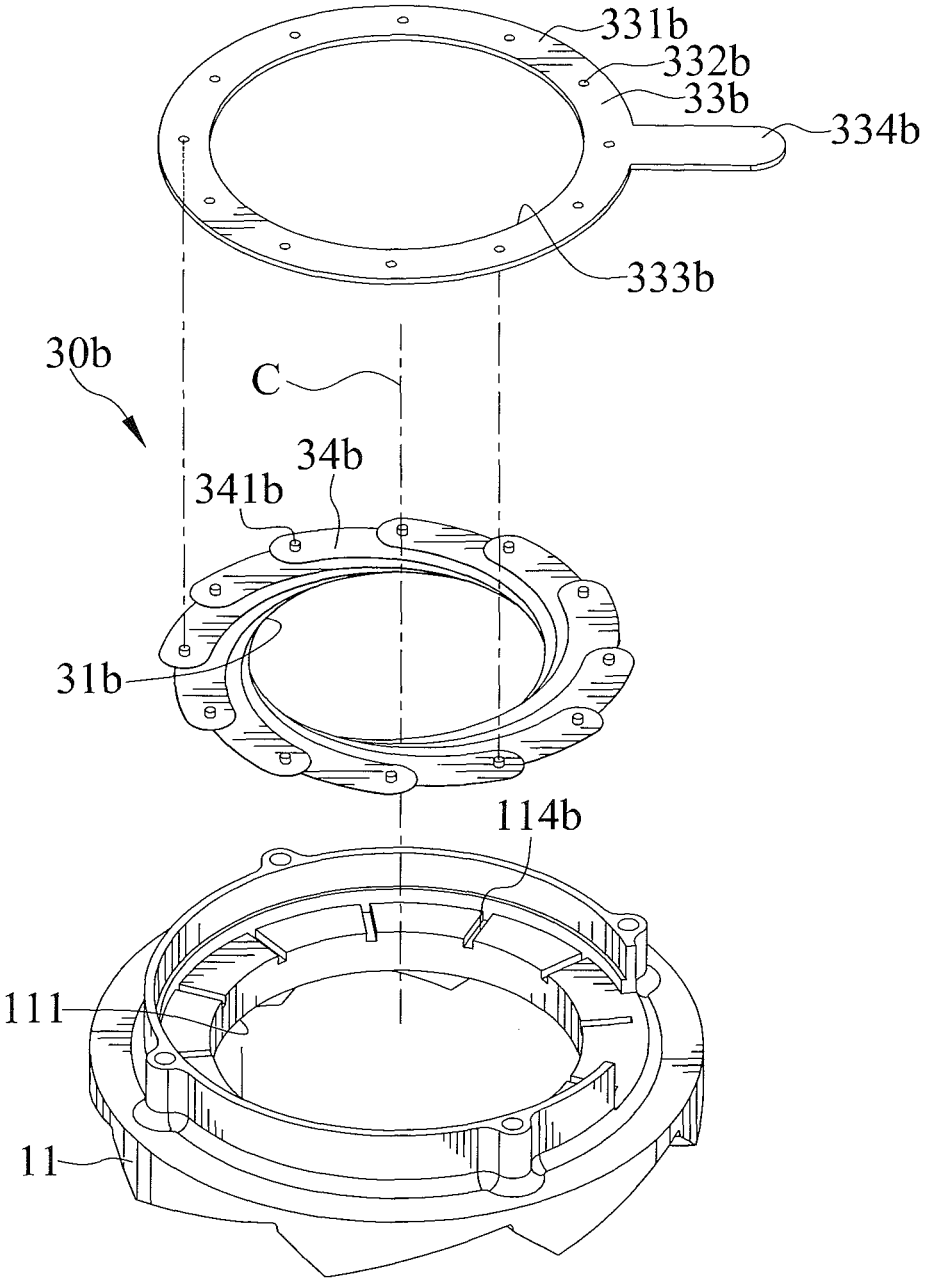
FIG. 10 is another exploded view of the adjustable vortex flame device of FIG. 9.
Figure 11:
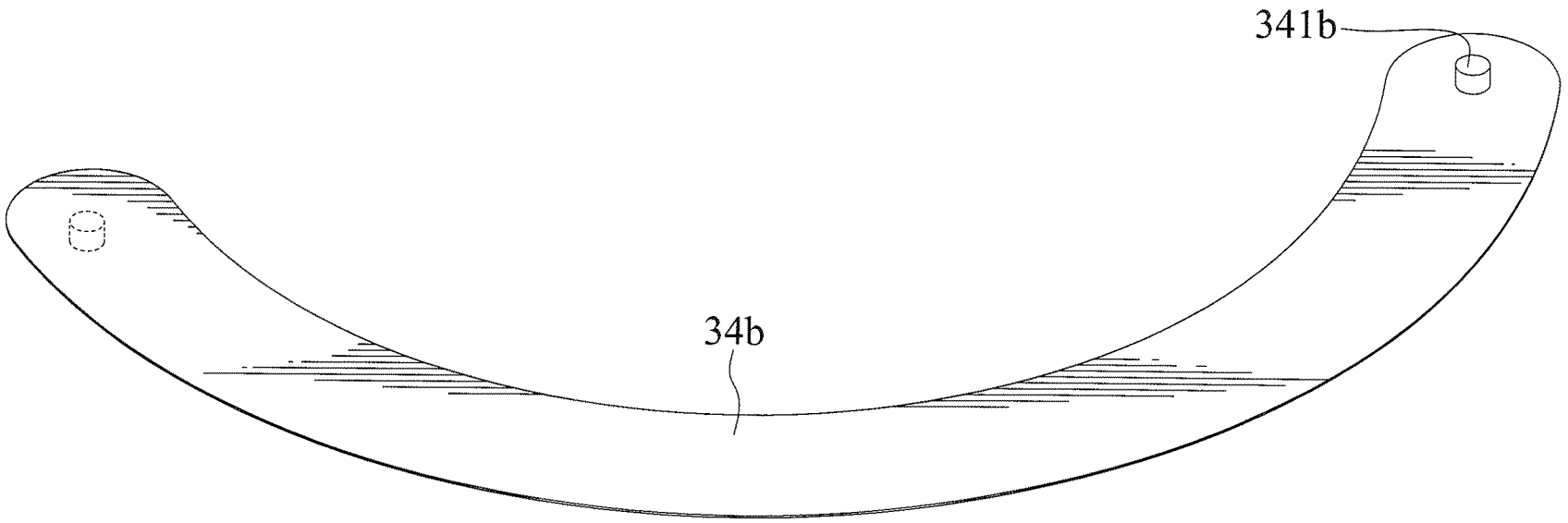
FIG. 11 is a perspective view showing one of a plurality of plates of a control mechanism of the adjustable vortex flame device.
Figure 12:
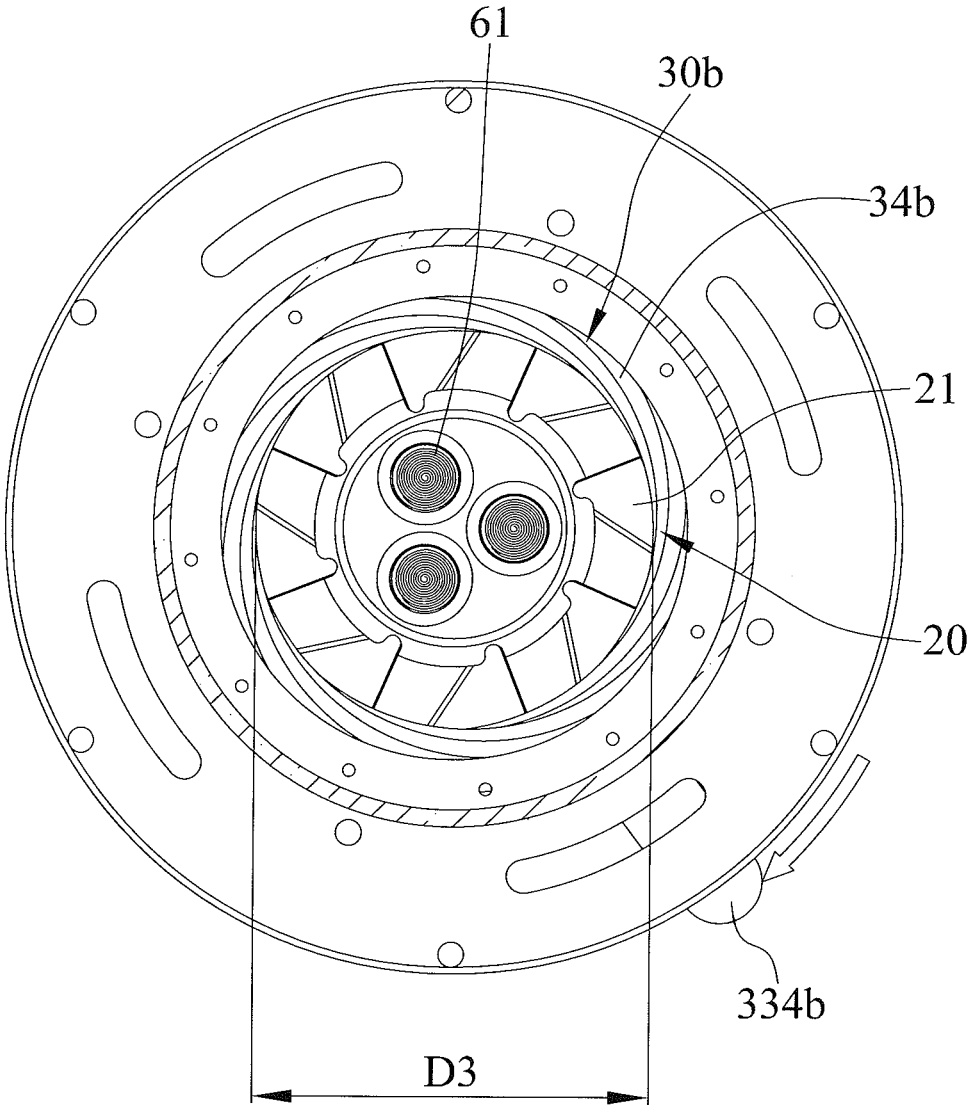
FIG. 12 is a top view of the adjustable vortex flame device of FIG. 9.
Figure 13:
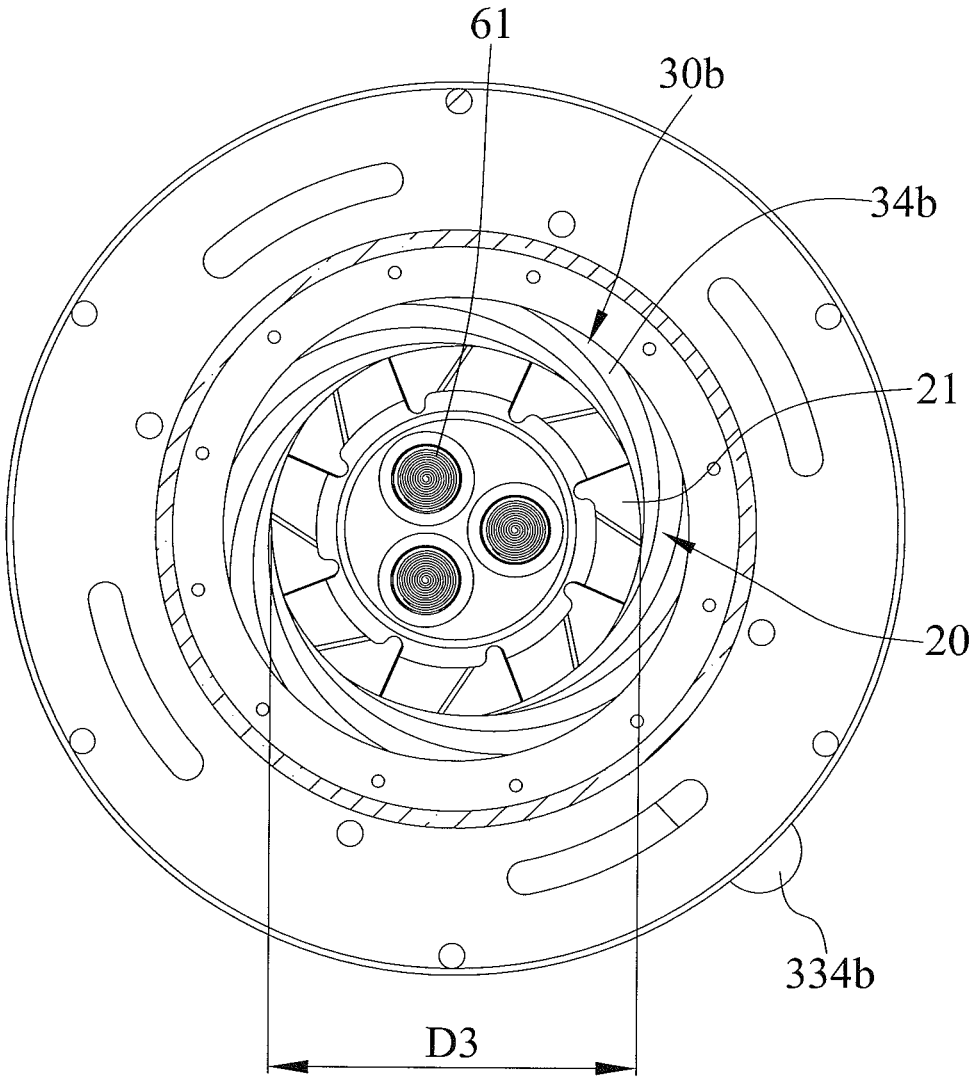
FIG. 13 is a top view similar to FIG. 12, but shows the control mechanism in a setting different from that of FIG. 12.
Figure 14:
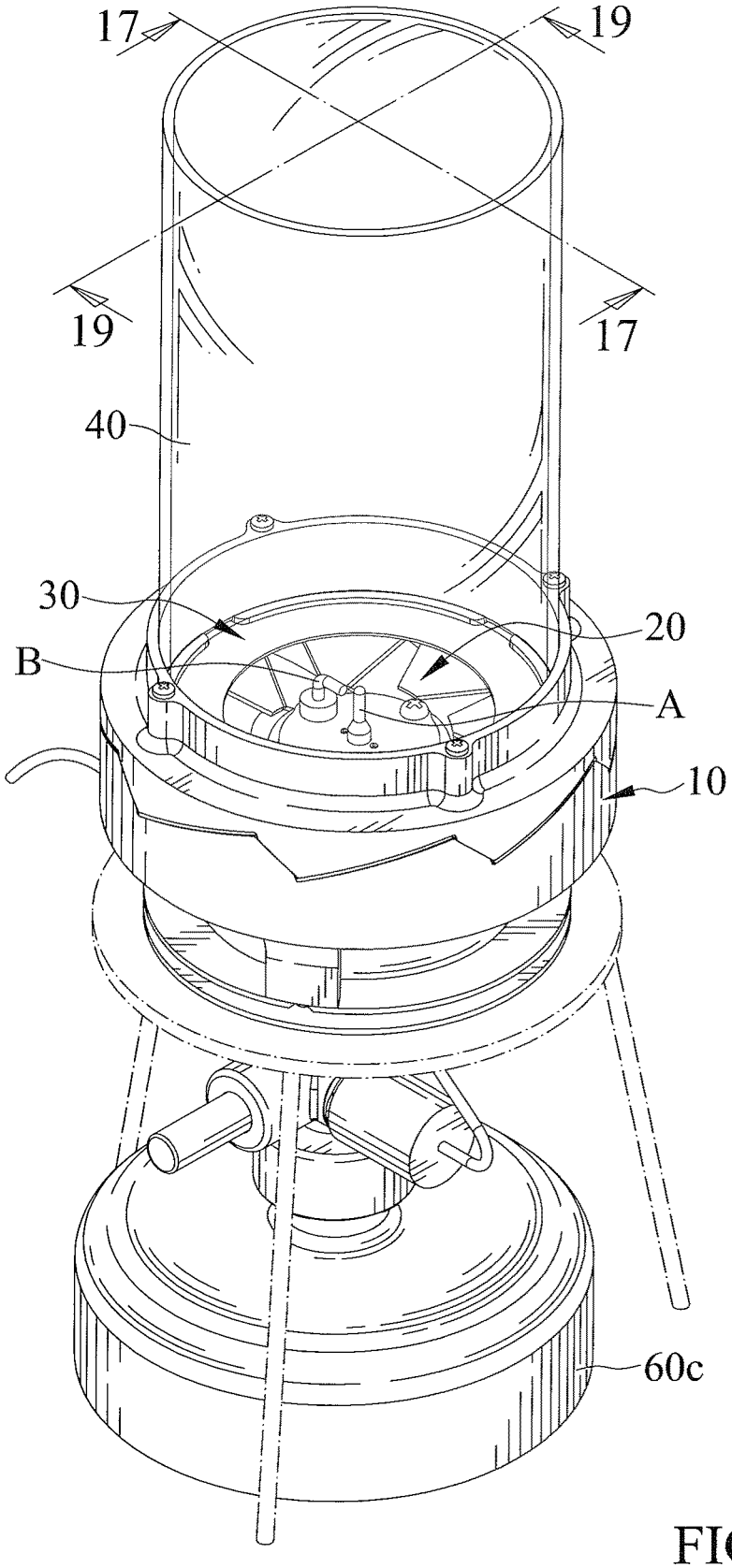
FIG. 14 is a perspective view of an adjustable vortex flame device in accordance with a third embodiment of the present invention.
Figure 15:
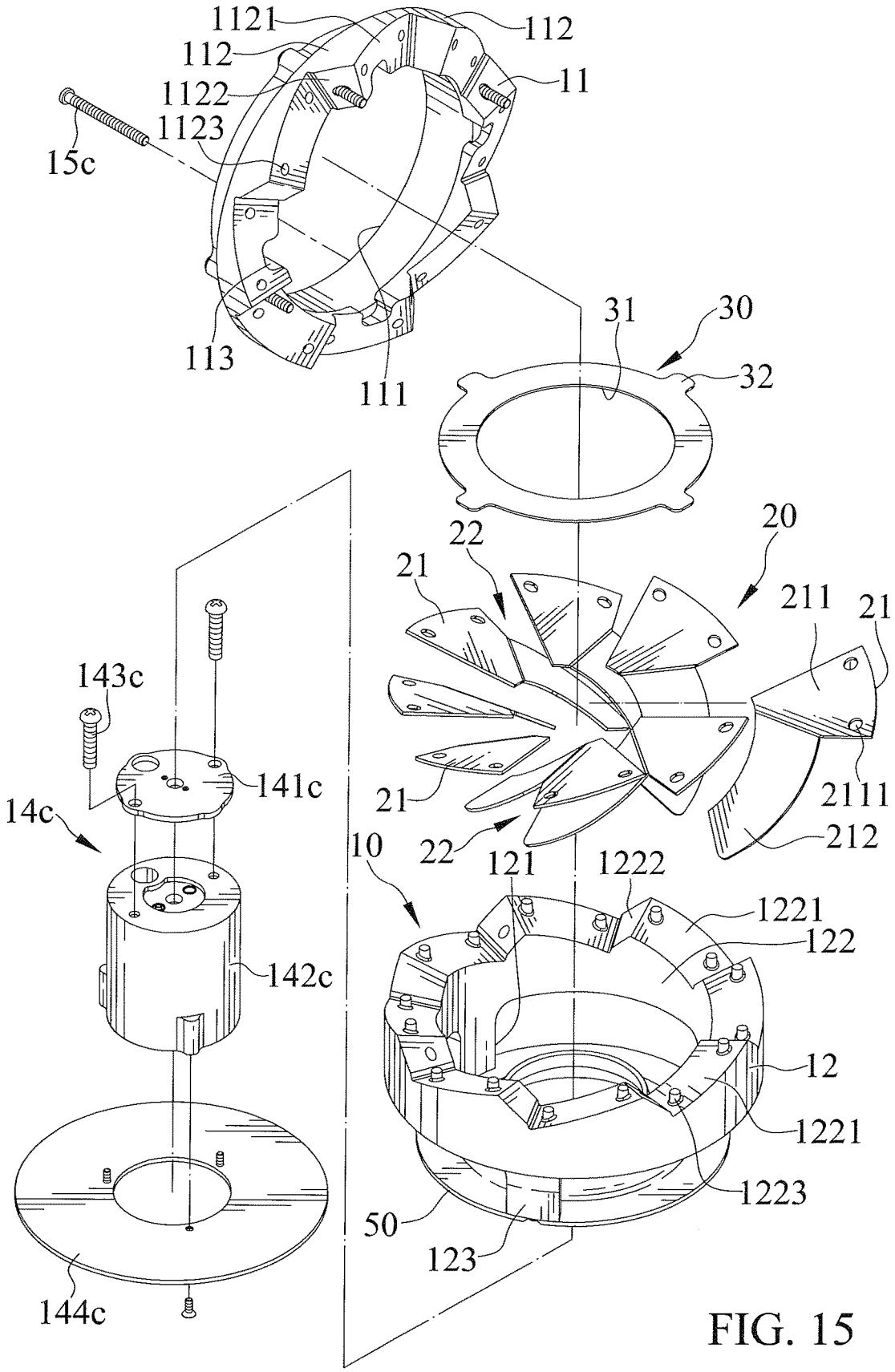
FIG. 15 is a partial, exploded perspective view of the adjustable vortex flame device of FIG. 14.
Figure 16:
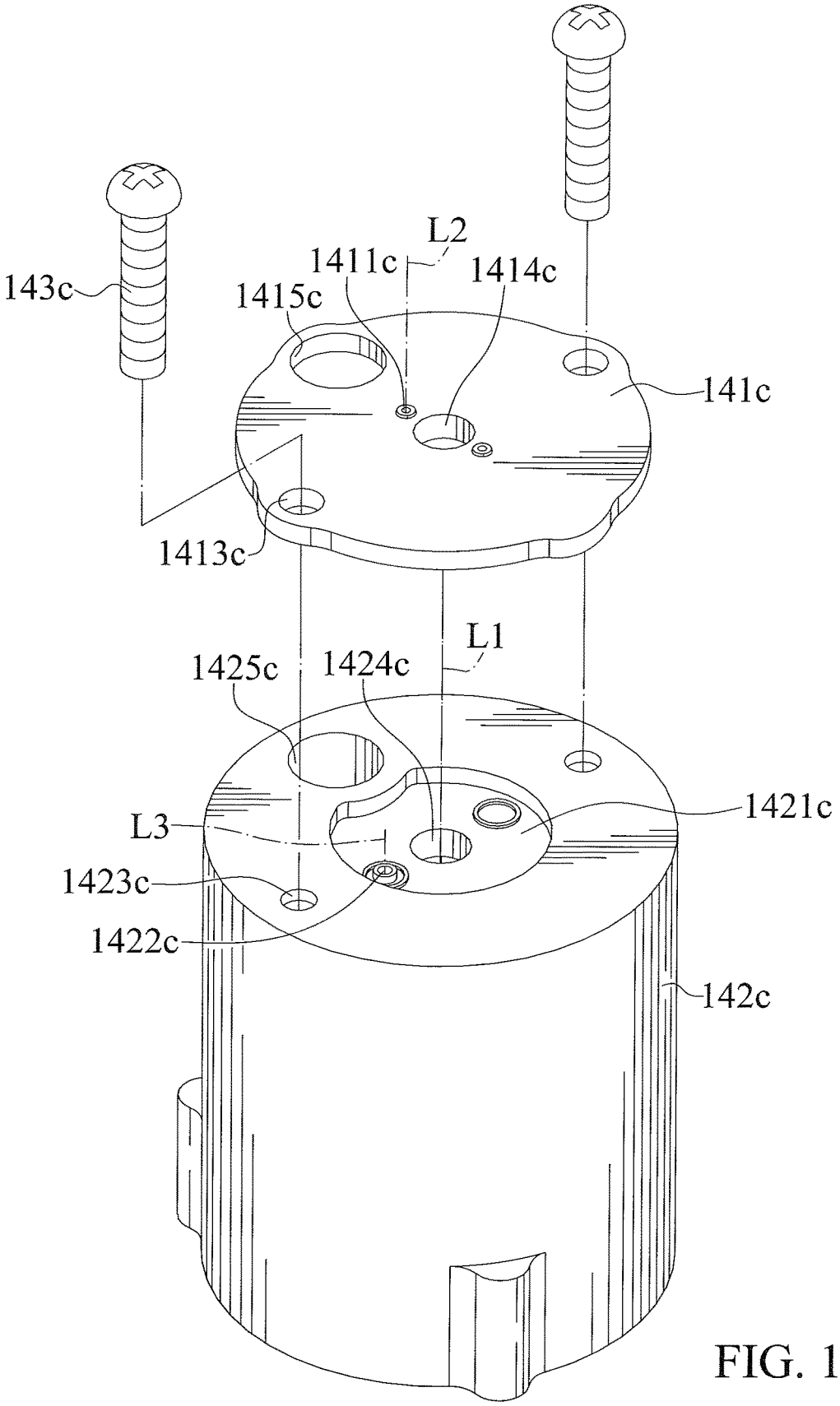
FIG. 16 is an exploded perspective view of a flow control head of the adjustable vortex flame device of FIG. 14.
Figure 17:
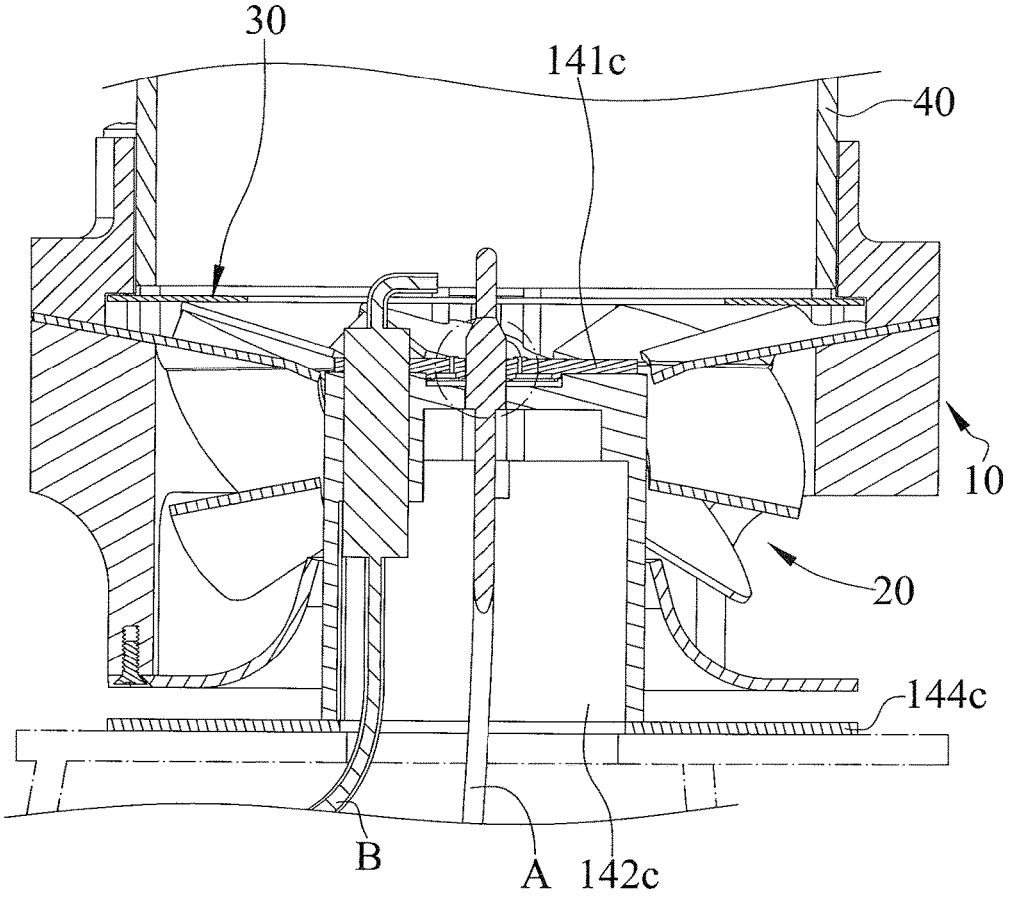
FIG. 17 is a partial, cross-sectional view taken along line 17-17 of FIG. 14.
Figure 18:
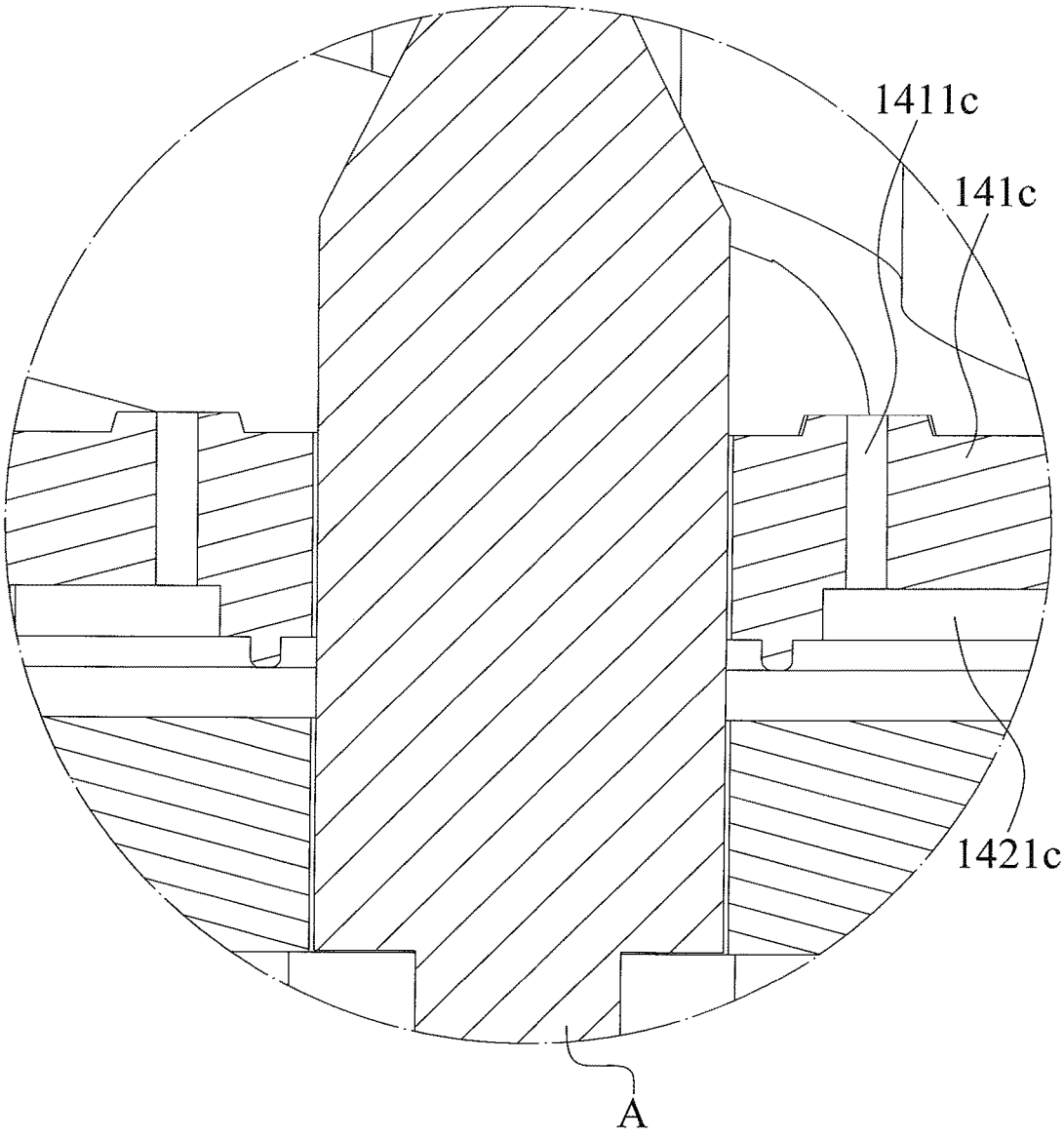
FIG. 18 is a partial, enlarged view of FIG. 17.
Figure 19:
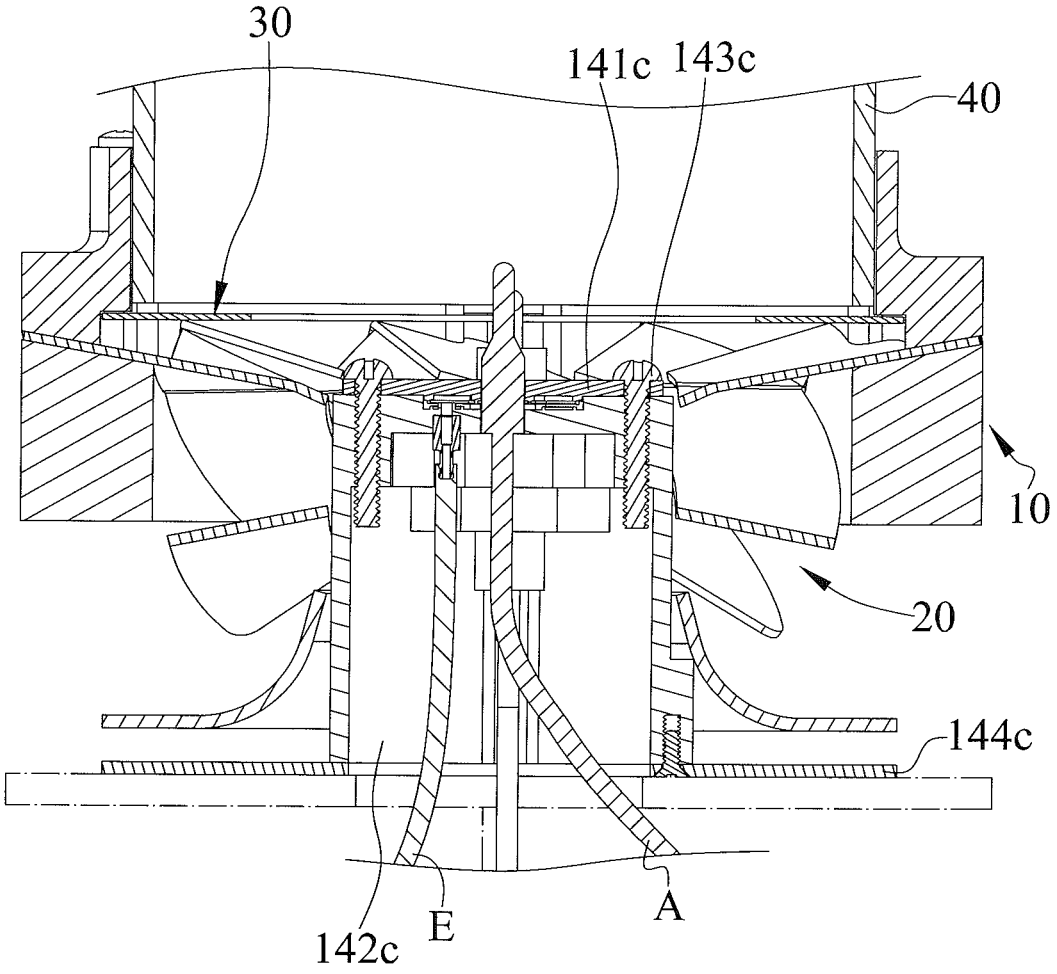
FIG. 19 is partial, cross section view taken along line 19-19 of FIG. 14.
Figure 20:
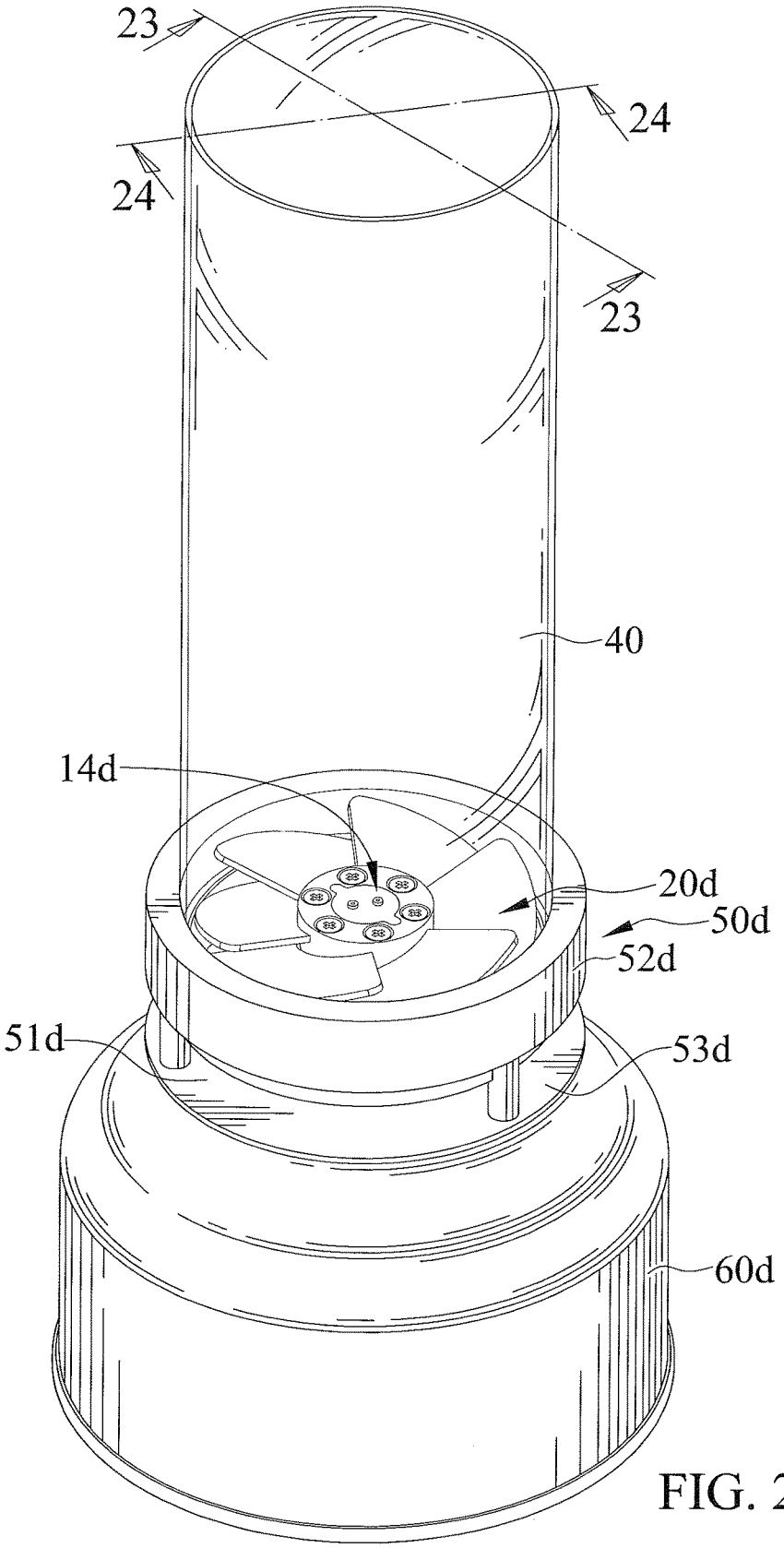
FIG. 20 is a perspective view of an adjustable vortex flame device in accordance with a fourth embodiment of the present invention.
Figure 21:
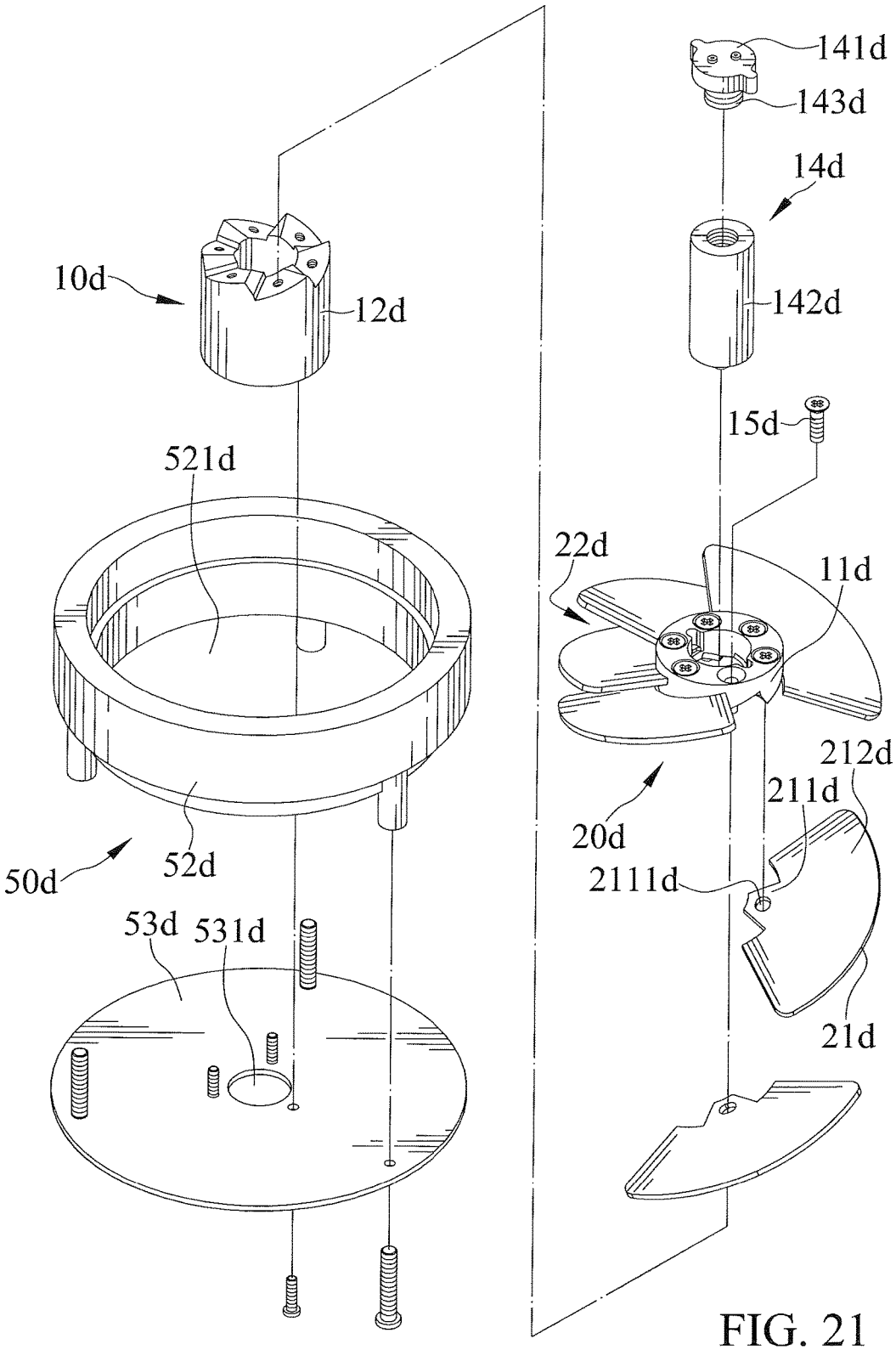
FIG. 21 is a partial, exploded perspective view of the adjustable vortex flame device of FIG. 20.
Figure 22:
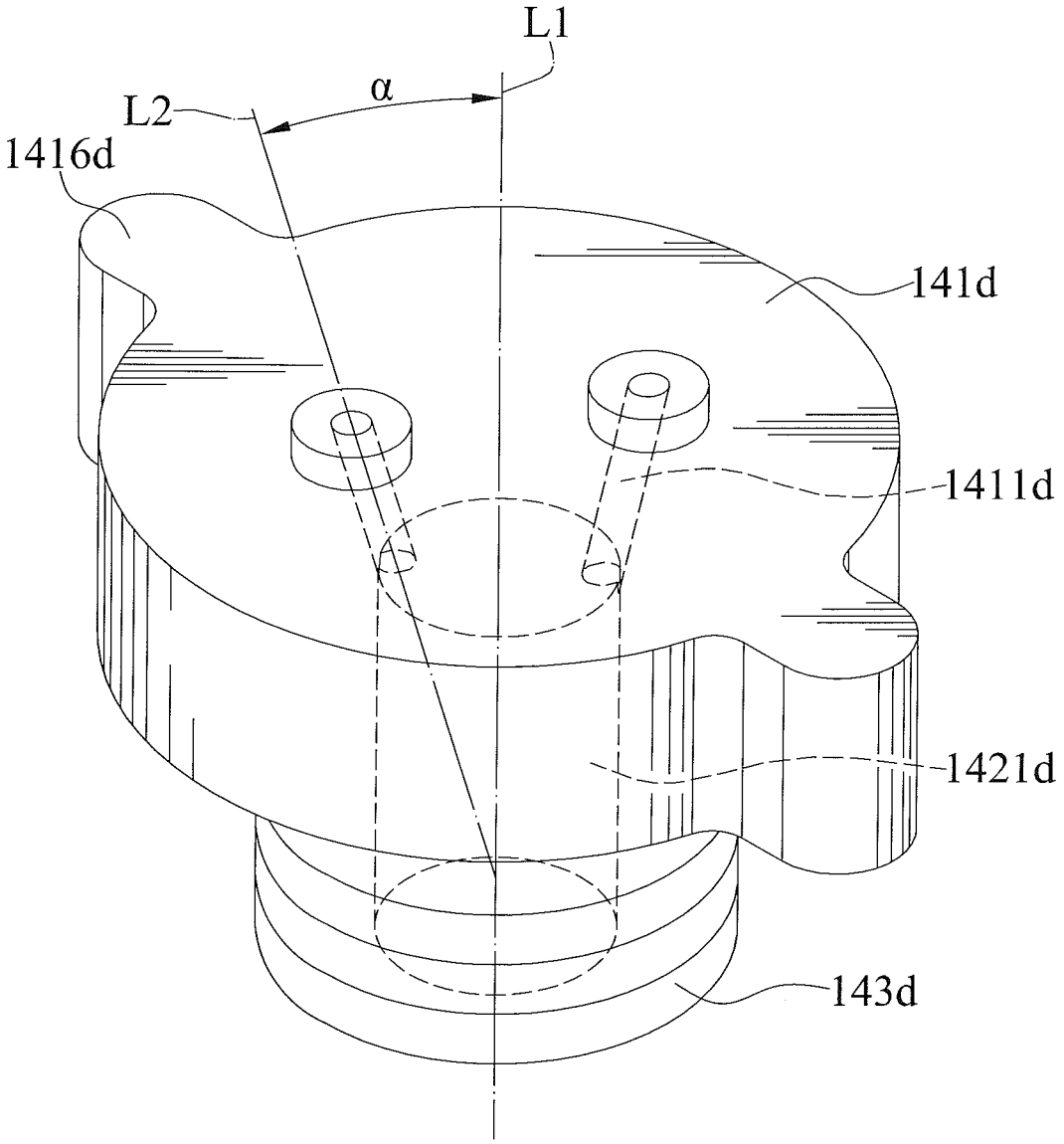
FIG. 22 is a perspective view of a first member of a flow control head of the adjustable vortex flame device of FIG. 20.
Figure 23:
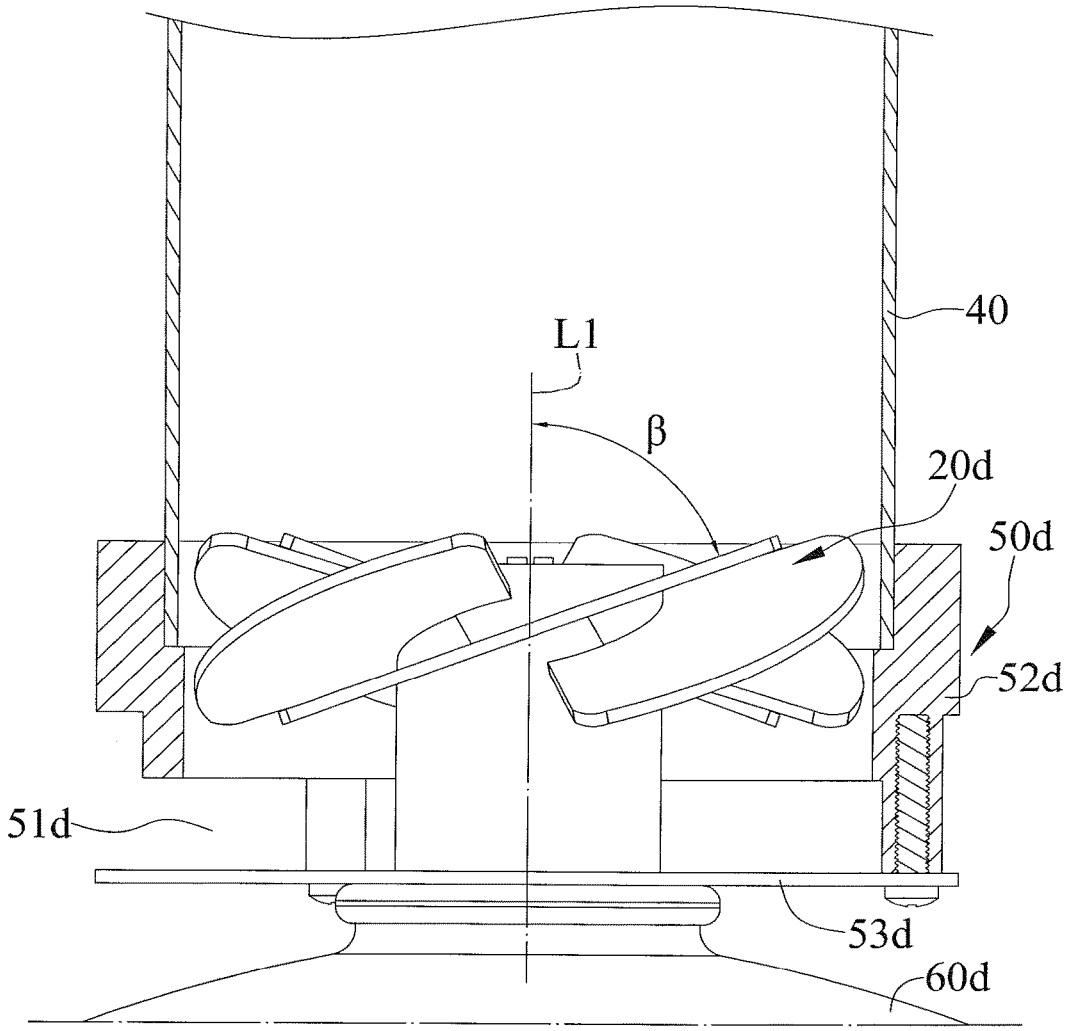
FIG. 23 is a partial, cross-sectional view taken along line 23-23 of FIG. 20.
Figure 24:
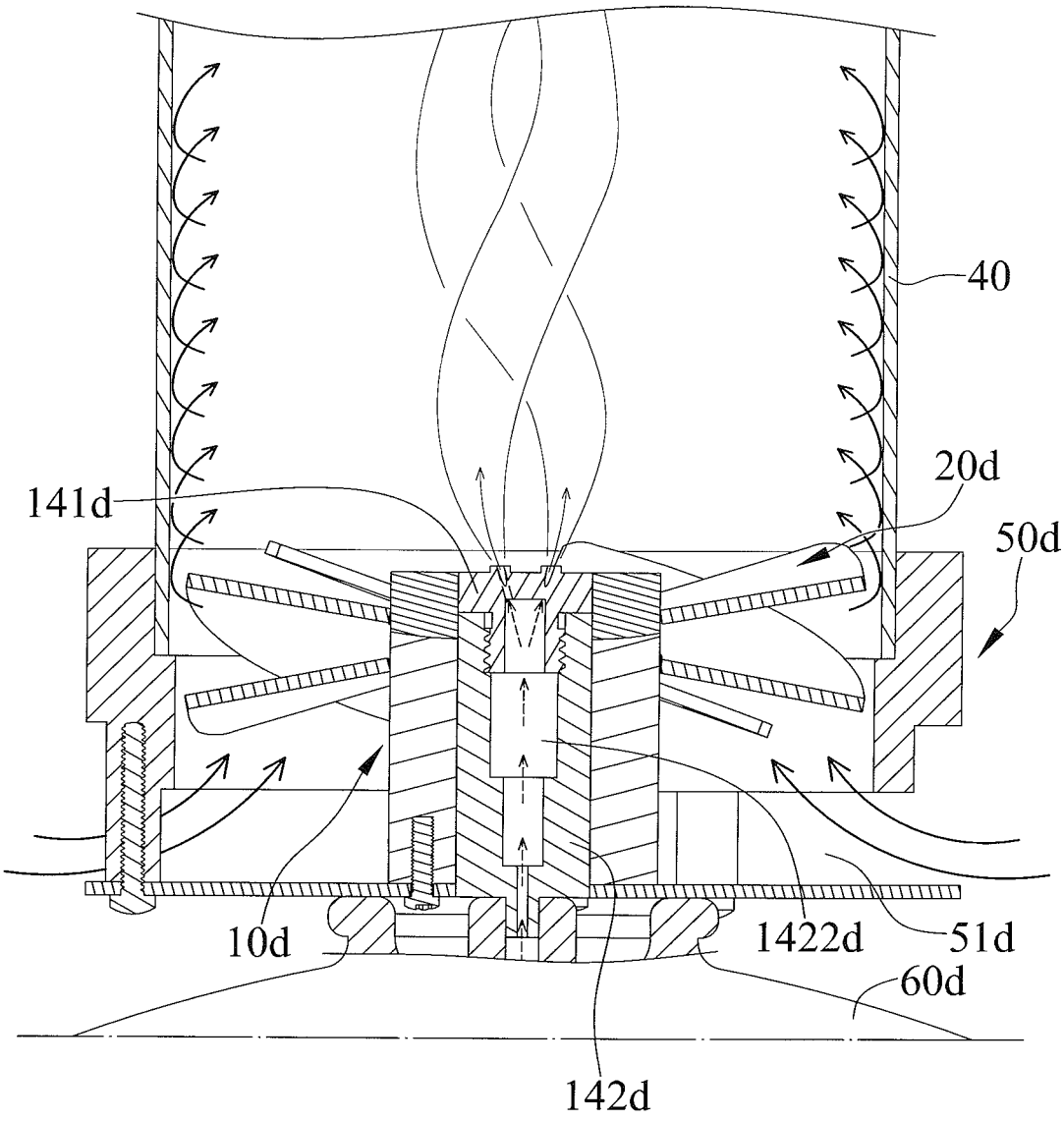
FIG. 24 is a partial, cross-sectional view taken along line 24-24 of FIG. 20, with the adjustable vortex showing the adjustable vortex flame device producing a vortex flame, and with arrows indicating air flows.
Figure 25:
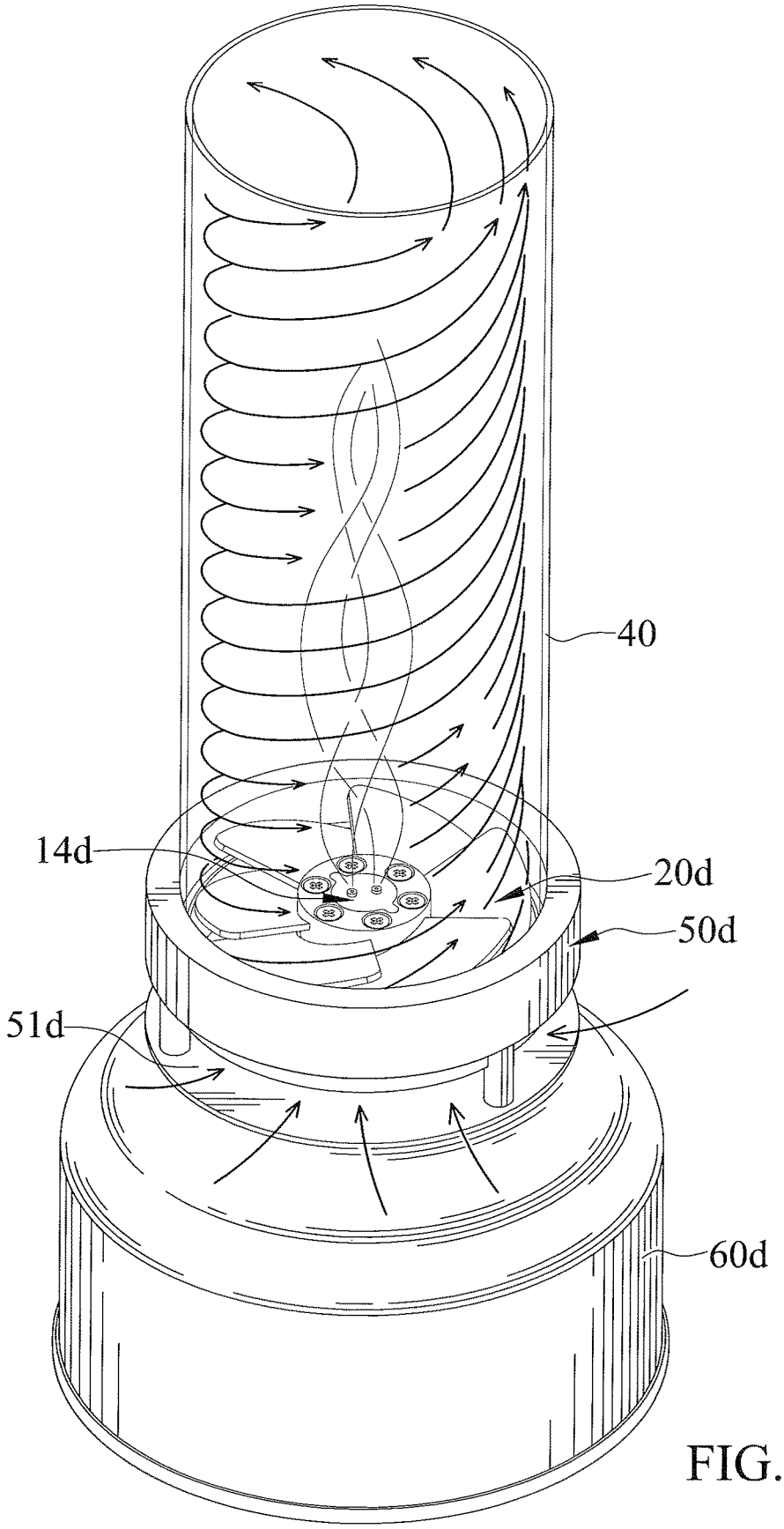
FIG. 25 is a perspective view of the adjustable vortex flame device of FIG. 20, with the adjustable vortex flame device producing a vortex flame, and with arrows indicating air flows.

FIG. 8 is a cross-sectional view similar to FIG. 7, except that a hole 31*a* delimited by a control mechanism 30*a* of the adjustable vortex flame device is in another size in which a vortex flame of the adjustable vortex flame device is in another size. The hole 31*a* has a diametrical size D2, which is greater than the diametrical size D1 of the hole 31. Therefore, a vortex flame of the adjustable vortex flame device shown in FIG. 8 has a larger size than a vortex flame of the adjustable vortex flame device shown in FIG. 7.

FIGS. 9 through 12 show an adjustable vortex flame device in accordance with a second embodiment of the present invention. The second embodiment is similar to the first embodiment. A control mechanism 30*b* includes an actuating member 33*b* and a plurality of plates 34*b*. The actuating member 33*b* includes an annular structure 331*b*, a plurality of first joining ends 332*b* disposed between inner and outer peripheries of and distributed circumferentially on the annular structure 331*b*, and a through hole 333*b* delimited by the inner periphery of the annular structure 331*b* and corresponding to and in communication with the opening 13. The plurality of first joining ends 332*b* is distanced from one another along a circumferential direction on the annular structure 331*b* equally. The plurality of plates 34*b* collaboratively delimits the hole 31*b* and is engaged with the actuating member 33*b*. A diametrical size of the hole 31*b* is varied dependent upon different relative positions of the plurality of plates 34*b*, and the actuating member 33*b* is operable to move relative positions of the plurality of plates 34*b*. D3 indicates a diametrical size of the hole 31*b*. The actuating member 33*b* includes a control input 334*b* for facilitating operation thereof. The control input 334*b* defines an extension projection from the annular structure 331*b* of the actuating member 33*b*. The control input 334*b* projects radially away from the outer periphery of the actuating member 33*b*. Each of the plurality of plates 34*b* has a crescent shape. The plurality of plates 34*b* is stacked together one after another. The actuating member 33*b* is pivotal about an axis of the control head 10, and the plurality of plates 34*b* is rotated circumferentially and selectively moves close to or away from a center axis C of the hole 31*b* with respect to a pivotal movement of the actuating member 1134*b*. Two opposite ends of each of the plurality of plates 34*b* each include a second joining end 341*b*, and each of the plurality of plates 34*b* includes one second joining end 341*b* engaged with one of the plurality of first joining ends 332*b* and the other second joining end 341*b* engaged with one of a plurality of embedding sections 114*b* of the control head 10. The plurality of embedding sections 114*b* is defined on the base. The plurality of first joining ends 332*b* defines a plurality of apertures, and the plurality of second joining ends 341*b* defines a plurality of projections respectively. Each of the plurality of plates 34*b* includes a top surface thereof including one of the two projections projecting therefrom and engaged with one of the plurality of apertures and a bottom surface thereof including the other of the two projections projecting therefrom engaging with one of the plurality of embedding sections 114*b*. The plurality of embedding sections 114*b* defines a plurality of recesses.

FIGS. 14 through 19 show an adjustable vortex flame device in accordance with a third embodiment of the present invention. The third embodiment is similar to the first embodiment. At least one fastener 15*c* is used to secure the first and second base members 11 and 12 together. The at least one fastener 15*c* includes outer threads, and the first and second base members 11 and 12 each includes at least one engaging hole having inner threads. The at least one fastener 15*c* engages in and is in thread engagement with the engaging holes of the first and second base members 11 and 12.

A flow control head 14*c* inserts in the through hole delimited by the control head 10. The flow control head 14*c* includes a first member 141*c* and a second member 142*c* detachably engaging with the first member 141*e*. The first member 141*c* is disposed above the second member 142*c* in a vertical direction. The first and second members 141*c* and 142*c* are secured by a fastening means. The fastening means are bolts 143*c*. Two bolts 143*c* are used to secure the first and second members 141*c* and 142*c* together. The first member 141*c* includes two first holes 1413*c* extending therethrough. The second member 142*c* includes two second holes 1423*c* extending therein. The first and second members 141*c* and 142*c* are secured together with the two bolts 143*c* respectively inserting through the two first holes 1413*c* and engaging in the two second holes 1423*c*. Each of the two bolts 143*c* has outer threads. A platform 144*c* bears the second member 142*c* of the flow control head 14*c*. The flow control head 14*c* delimits a first chamber 1421*c* and a second chamber 1422*c* connecting to the first chamber 1421*c*. Two channels 1411*c* extend in the first member 141*c* and to an outer periphery of the flow control head 14*c* and connect to the first chamber 1421*c*. The flow control head 14*c* has two flow outlets defined at distal ends of the two channels 1411*c* and a flow inlet defined at a distal end of the second chamber 1422*c*. The adjustable vortex flame device in use includes a fuel reservoir 60*c* fluidly connecting to the flow inlet of the flow control head 14*c*. The first chamber 1421*c* is disposed between and interconnects the two channels 1411*c* and the second chamber 1422*c*. The first chamber 1421*c* extends longitudinally along a first axis L1. The two channels 1411*c* are disposed symmetrically with respect to the first axis L1.

Each of the two channels 1411*c* extends longitudinally along a second axis L2. The second axis L2 offsets radially from the first axis L1. Each of the flow outlets radially offsets from the first axis L1 at a first radial distance. The first chamber 1421*c* is substitutable with another first chamber 1421*c* which includes each of the flow outlets radially offsetting from the first axis L1 at a second radial distance different from the first radial distance. The second chamber 1422*c* extends longitudinally along a third axis L3. The third axis L3 is parallel to the first axis L1. The third axis L3 is offset radially from the first axis L1.

A heat detecting system A adapted to detect a temperature of a vortex flame of the adjustable vortex flame device inserts through the flow control head 14*c*. The first member 141*c* includes a third hole 1414*c* extending therethrough. The second member 142*c* includes a fourth hole 1424*c* extending therethrough. The heat detecting system. A inserts through the flow control head 14*c* from the third and fourth holes 1414*c* and 1424*c*. When the first and second members 141*c* and 142*c* are secured together, the third and fourth holes 1414*c* and 1424*c* correspond to each other. Centers of the third and fourth holes 1414*c* and 1424*c* are disposed on the first axis L1.

An ignition system B also extends through the flow control head 14*c*. The first member 141*c* includes a fifth hole 1415*c* extending therethrough. The second member 142*c* includes a sixth hole 1425*c* extending therethrough. The ignition system B extends through the flow control head 14*c* from the fifth and sixth holes 1415*c* and 1425*c*. When the first and second members 141*c* and 142*c* are secured together, the fifth and sixth holes 1415*c* and 1425*c* correspond to each other. Centers of the fifth and sixth holes 1415*c* and 1425*c* are disposed on the first axis L1.

A pipe E can deliver fuel in the fuel reservoir 60*c* to the flow control head 14*c*. The pipe E has a first end fluidly engaging with the fuel reservoir 60*c* and a second end inserting in the second chamber 1422*c*. The second end of the pipe E protrudes into the first chamber 1421*c*.

FIGS. 20 through 25 show an adjustable vortex flame device in accordance with a second embodiment of the present invention. The fourth embodiment is similar to the third embodiment. A control head 10*d* includes a base having an inner periphery thereof delimiting an opening 13. A flow guiding and control mechanisms 20*d* and 30*d* are mounted on the base. The base includes a first base member 11*d* and a second base member 12*d* joined to the first base member 11*d*. The first base member 11*d* has a first engaging end, and the second base member 12*d* has a second engaging end engaging with the first engaging end. The first engaging end forms a plurality of first ridges each including first and second edges and an apex defined therebetween and the second engaging end forms a plurality of second ridges each including third and fourth edges and an apex defined therebetween respectively. The first and second edges of one of the plurality of first ridges correspondingly face the third and fourth edges of one of the plurality of second ridges. The first and second edges of one of the plurality of first ridges have an included angle of greater than 90 degrees. The third and fourth edges of one of the plurality of second ridges have an included angle of greater than 90 degrees. At least one fastener 15*d* is used to secure first and second base members 11*d* and 12*d* together. The at least one fastener 15*d* includes outer threads, and the first and second base members 11*b* and 12*d* each includes at least one engaging hole having inner threads. The at least one fastener 15*d* engages in and is in thread engagement with the engaging holes of the first and second base members 11*d* and 12*d*.

A flow control head 14*d* inserts in a through hole delimited by a control head 10*d*. The flow control head 14*d* includes a first member 141*d* and a second member 142*d* detachably engaging with the first member 141*d*. The first member 141*d* is disposed above the second member 142*d* in a vertical direction. The first and second members 141*c* and 142*c* are secured by a fastening means. The fastening means defines outer threads 143*d* on the outer periphery of the first member 141*d* and inner threads on the inner periphery of the second chamber 1422*d*. The first and second members 141*d* and 142*d* are secured together with the outer thread 143*d* engaging with the inner threads. The first member 141*d* includes an outer periphery thereof including at least one ear 1416*d* protruding therefrom. It is effort saving and convenient that a user can grip and apply a force on the ear 1416*d* to join the first member 141*d* to the second member 142*d*. The flow control head 14*d* delimits a first chamber 1421*d* and a second chamber 1422*d* connecting to the first chamber 1421*d*. Two channels 1411*d* extend in the first member 141*d* and to an outer periphery of the flow control head 14*d* and connect to the first chamber 1421*d*. The flow control head 14*d* has two flow outlets defined at distal ends of the two channels 1411*d* and a flow inlet defined at a distal end of the second chamber 1422*d*. The adjustable vortex flame device in use includes a fuel reservoir 60*d* fluidly connecting to the flow inlet of the flow control head 14*d*. The first chamber 1421*d* is disposed between and interconnects the two channels 1411*d* and the second chamber 1422*d*. The first chamber 1421*d* extends longitudinally along a first axis L1. The two channels 1411*d* are disposed symmetrically with respect to the first axis L1. Each of the two channels 1411*d* extends longitudinally along a second axis L2. The second axis L2 offsets radially from the first axis L1. Each of the flow outlets radially offsets from the first axis L1 at a first radial distance. The first chamber 1421*d* is substitutable with another first chamber 1421*d* which includes each of flow outlets radially offsetting from the first axis L1 at a second radial distance different from the first radial distance. The second chamber 1422*d* extends longitudinally along a third axis L3. The third axis L3 is parallel to the first axis L1. The third axis L3 is offset radially from the first axis L1. Each of the two channels 1411*d* extending obliquely from the first chamber 1421*d* to the outer periphery of the flow control head 14*d*. The two channels 1411*d* extend divergently from each other from the first chamber 1421*d* to the outer periphery of the flow control head 14*d*. The second axis L2 tilts from the first axis L1 at a first angle $\alpha$. The first angle $\alpha$ is less than 90 degrees. The first angle $\alpha$ is 17.5 degrees.

Each of the plurality of vanes 21*d* has a first extension 211 including a cavity 2111*d* and secured between the first edge of one of the plurality of first ridges and the third edge of one of the plurality of second ridges and a second extension 212*d* extending from the first extension 211*d*. An air passage 22*d* between the two adjacent vanes 21*d* is delimited by the second extensions 212*d* thereof. Each of the plurality of vanes 21*d* includes the second extension 212*d* thereof extending from the first extension 211*d*. The second extension 212*d* defines a surfac; and a tangent plane of the surface tilts from the first axis L1 at a second angle $\beta$. The second angle $\beta$ is greater than 45 degrees. The second angle $\beta$ is less than 90 degrees.

A seat 50*d* with at least one auxiliary air inlet 51*d* is fixed to and bears the base. The at least one auxiliary air inlet 51*d* is disposed below the flow guiding mechanism 20*c*1. The seat 50*d* includes a first seat member 52*d* and a second seat member 53*d* incorporating together to delimit the at least one auxiliary air inlet 51*d*. The first seat member 52*d* is an annular member and includes an inner periphery thereof delimiting a through hole 521*d*. The first seat member 52*d* includes at least two legs separating from each other, with a gap defined between the at least two legs. The second seat member 53*d* bears the first seat member 52*d*. The second seat member 53*d* is in a form of a platform with which a fuel reservoir 60*d* is adapted to connect. The second seat member 53*d* bears the first seat member 52*d* from the at least two legs of the first seat member 52*d*. Air flows through the at least one auxiliary air inlet 51*d* flow through the gap between the at least two legs. The second seat member includes an orifice 531*d* extending therethrough.

In view of the forgoing, the stack effect occurs in each of the adjustable vortex flame devices, and the negative pressure due to the stack effect in the shield 40 can induce the outside air into the adjustable vortex flame device. The Coanda effect also occurs in each of the adjustable vortex flame devices, with the outside air in the adjustable vortex flame device guided by the plurality of vanes 21 of the flow guiding mechanism 20 to flow spirally in the shield 40 and to attach to an inner peripheral wall of the shield 40. With the flow guiding mechanism 20, the Coanda effect in the adjustable vortex flame device is effective, so a flame of the adjustable vortex flame device is stable and smooth. Furthermore, the control mechanisms 30, 30*a*, and 30*b* delimit the holes 31, 31*a*, and 31*b* which vary with respect to different sizes of vortex flames of the adjustable vortex flame device. Each of the holes 31, 31*a*, and 31*b* is in a smaller diametrical size than the opening 13, so it is obvious to see vorticities of a vortex flame of each of the adjustable vortex flame devices. Furthermore, the flow control heads 14*c* and 14*d* enable the adjustable vortex flame device that produces a stable vortex flame. Each of the flow outlets radially offsets from the first axis L1 at the first radial distance, and Each of the first chambers 1421*c* and 1421*d* is substitutable with another first chamber 1421*c* and 1421*d* which includes each of flow outlets radially offsetting from the first axis L1 at the second radial distance different from the first radial distance with respect to a size of a vortex flame of the adjustable vortex flame device.

While the specific embodiments have been illustrated and described, numerous modifications come to mind without significantly departing from the spirit of invention, and the scope of invention is only limited by the scope of accompanying claims.

What is claimed is:

1. An adjustable vortex flame device comprising:

a control head delimiting a through hole with an opening and including a flow guiding mechanism, with the flow guiding mechanism including a plurality of vanes, with the plurality of vanes disposed around a circumference of the opening one after another, with two adjacent vanes including a spiral air passage formed therebetween, with the flow guiding mechanism including a flow control bead, with the flow control head inserting in the through hole, with the flow control head including a first member and a second member detachably engaging with the first member and delimiting a first chamber and a second chamber connecting to the first chamber, with two channels extending in the first member and to an outer periphery of the flow control head and connecting to the first chamber, with the flow control head having two flow outlets defined at distal ends of the two channels and a flow inlet defined at a distal end of the second chamber, with the adjustable vortex flame device in use including a fuel reservoir fluidly connecting to the flow inlet of the flow control head, with the first chamber extending longitudinally along a first axis, with the two channels disposed symmetrically with respect to the first axis, with each of the two channels extending longitudinally along a second axis, and with the second axis offsetting radially from the first axis; and a hollow and transparent shield disposed above the control head and delimiting a space fluidly connecting to the through hole, wherein the control head includes a control mechanism delimiting a hole, wherein the hole has a diametrical size and which varies with respect to a size of a vortex flame of the adjustable vortex flame device, wherein the hole corresponds to and is in fluid communication with the opening, and wherein the hole is in a smaller diametrical size than the opening.

2. The adjustable vortex flame device as claimed in claim 1, wherein each of the flow outlets radially offsets from the first axis at a first radial distance, and wherein the first member is substitutable with another first member which includes each of the flow outlets radially offsetting from the first axis at a second radial distance different from the first radial distance.

3. The adjustable vortex flame device as claimed in claim 1, wherein each of the two channels extends obliquely from the first chamber to the outer periphery of the flow control head.

4. The adjustable vortex flame device as claimed in claim 3, wherein the two channels extend divergently from each other from the first chamber to the outer periphery of the flow control head, with the second axis tilting from the first axis at a first angle, and with the first angle less than 90 degrees.

5. The adjustable vortex flame device as claimed in claim 4, wherein the first angle is 17.5 degrees.

6. The adjustable vortex flame device as claimed in claim 1, wherein a heat detecting system adapted to detect a temperature of a vortex flame of the adjustable vortex flame device inserts through the flow control head.

7. The adjustable vortex flame device as claimed in claim 1, wherein the control mechanism is an annular member secured to the first base member, and the hole is delimited by an inner periphery of the annular member.

8. The adjustable vortex flame device as claimed in claim 1, wherein the control head includes a base having an inner periphery thereof delimiting the opening, and wherein the flow guiding and control mechanisms are mounted on the base.

9. The adjustable vortex flame device as claimed in claim 1 further comprising a seat with at least one auxiliary air inlet fixed to and bearing the base.

10. The adjustable vortex flame device as claimed in claim 9, wherein the at least one auxiliary air inlet is disposed below the flow guiding mechanism.

11. An adjustable vortex flame device comprising:

a control head delimiting a through hole with an opening and including a flow guiding mechanism, with the flow guiding mechanism including a plurality of vanes, with the plurality of vanes disposed around a circumference of the opening one after another, with two adjacent vanes including a spiral air passage formed therebetween, with the flow guiding mechanism including a flow control head, with the flow control head inserting in the through hole, with the flow control head including a first member and a second member detachably engaging with the first member and delimiting a first chamber and a second chamber connecting to the first chamber, with two channels extending in the first member and to an outer periphery of the flow control head and connecting to the first chamber, with the flow control head having two flow outlets defined at distal ends of the two channels and a flow inlet defined at a distal end of the second chamber, with the adjustable vortex flame device in use including a fuel reservoir fluidly connecting to the flow inlet of the flow control head, with the first chamber extending longitudinally along a first axis, with the two channels disposed symmetrically with respect to the first axis, with each of the two channels extending longitudinally along a second axis, and with the second axis offsetting radially from the first axis; and a hollow and transparent shield disposed above the control head and delimiting a space fluidly connecting to the through hole, wherein the control head includes a base having an inner periphery thereof delimiting the opening, wherein the flow guiding and control mechanisms are mounted on the base, wherein the base includes a first base member and a second base member joined to the first base member, wherein the first base member has a first engaging end and the second base member has a second engaging end engaging with the first engaging end, wherein the first engaging end forms a plurality of first ridges each including first and second edges and an apex defined therebetween and the second engaging end forms a plurality of second ridges each including third and fourth edges and an apex defined therebetween respectively, wherein the first and second edges of one of the plurality of first ridges correspondingly face the third and fourth edges of one of the plurality of second ridges, wherein the first and second edges of one of the plurality of first ridges have an included angle of greater than 90 degrees, and wherein the third and fourth edges of one of the plurality of second ridges have an included angle of greater than 90 degrees.

12. The adjustable vortex flame device as claimed in claim 11, wherein each of the plurality of vanes has a first extension secured between the first edge of one of the plurality of first ridges and the third edge of one of the plurality of second ridges and a second extension extending from the first extension, wherein the air passage between the two adjacent vanes are delimited by the second extensions thereof.

13. The adjustable vortex flame device as claimed in claim 12, wherein each of the plurality of vanes includes the second extension thereof extending from the first extension obliquely, with the first and second extensions having an included angle of greater than 90 degrees.

14. The adjustable vortex flame device as claimed in claim 12, wherein each of the plurality of vanes includes the second extension thereof extending from the first extension, and wherein the second extension defines a surface and a tangent plane of the surface tilts from the first axis at a second angle, and with the second angle greater than 45 degrees.

* * * * *